US009273480B2

(12) United States Patent
Larochelle

(10) Patent No.: US 9,273,480 B2
(45) Date of Patent: Mar. 1, 2016

(54) METHOD AND APPARATUS FOR REPAIRING AND SEALING DOOR AND WINDOW JAMBS, FRAMES, AND EXTERIOR TRIM

(71) Applicant: Michel R. Larochelle, Bedford, NH (US)

(72) Inventor: Michel R. Larochelle, Bedford, NH (US)

( * ) Notice: Subject to any disclaimer, the term of this patent is extended or adjusted under 35 U.S.C. 154(b) by 0 days.

(21) Appl. No.: 14/219,264

(22) Filed: Mar. 19, 2014

(65) Prior Publication Data

US 2015/0152659 A1 Jun. 4, 2015

Related U.S. Application Data

(60) Provisional application No. 61/910,336, filed on Nov. 30, 2013.

(51) Int. Cl.

| | |
|---|---|
| ***E02D 37/00*** | (2006.01) |
| ***E04G 23/02*** | (2006.01) |
| ***E06B 1/34*** | (2006.01) |

(52) U.S. Cl.

CPC ..... *E04G 23/0277* (2013.01); *E06B 1/34* (2013.01)

(58) Field of Classification Search

CPC ..... E04G 21/30; E04G 23/0277; E06B 1/34
USPC ..... 52/514, 204.1, 745.15, 98
See application file for complete search history.

(56) References Cited

U.S. PATENT DOCUMENTS

| | | | | |
|---|---|---|---|---|
| 2,837,787 | A * | 6/1958 | Wright | 52/717.01 |
| 3,024,504 | A * | 3/1962 | Miller | 49/489.1 |
| 3,271,919 | A * | 9/1966 | Olton | 52/800.13 |
| 3,690,082 | A * | 9/1972 | Byland | 52/213 |
| 3,764,173 | A * | 10/1973 | Griffith | 292/346 |
| 3,868,804 | A * | 3/1975 | Tantlinger | 52/98 |
| 4,098,027 | A * | 7/1978 | Crance | 49/504 |
| 4,877,673 | A * | 10/1989 | Eckel et al. | 428/172 |
| 4,916,871 | A * | 4/1990 | Anderson | 52/98 |
| 5,203,130 | A * | 4/1993 | Freelove | 52/211 |
| 5,214,880 | A * | 6/1993 | Woodruff et al. | 49/490.1 |
| 5,836,118 | A | 11/1998 | Thornton et al. | |
| 5,836,628 | A * | 11/1998 | Beier | 292/346 |
| 5,953,862 | A * | 9/1999 | Earhart et al. | 52/98 |
| 6,131,348 | A * | 10/2000 | Dunham | 52/287.1 |
| 6,374,545 | B1 * | 4/2002 | Baczuk | 49/470 |
| 6,425,222 | B1 | 7/2002 | Hagel | |
| 6,691,466 | B2 * | 2/2004 | Childress | 49/462 |
| 6,694,696 | B2 | 2/2004 | Hagel | |
| 6,826,877 | B1 * | 12/2004 | Stradel | 52/211 |
| 7,010,830 | B2 * | 3/2006 | Sirochman | 16/93 R |
| 7,204,059 | B2 * | 4/2007 | Schiffmann et al. | 52/211 |
| 7,543,864 | B2 | 6/2009 | Barthel | |
| 2004/0098940 | A1 | 5/2004 | Latessa et al. | |
| 2004/0206033 | A1 | 10/2004 | Hagel | |
| 2009/0077909 | A1 | 3/2009 | Barthel | |
| 2010/0269431 | A1 | 10/2010 | Young | |

* cited by examiner

*Primary Examiner* — Basil Katcheves
(74) *Attorney, Agent, or Firm* — Z IP Law PLLC; Claire Zopf

(57) ABSTRACT

A method and apparatus for the repair of door and window jambs or other exterior surface trim of a building and more specifically to the manufacturing of protective covers of a water and environmentally resistant material that are pre-dimensioned to fit all or a portion of standard and non-standard sized door or window jamb, frames or exterior trim using a unique preformed groove. The protective covers may further be included in a kit that provides for a homeowner to easily size the covers to the appropriate dimension and perform a repair.

5 Claims, 22 Drawing Sheets

METHOD AND APPARATUS FOR REPAIRING AND SEALING DOOR AND WINDOW JAMBS, FRAMES, AND EXTERIOR TRIM

RELATED PATENT APPLICATIONS

This application claims the benefit of U.S. Provisional Patent Application No. 61/910,336 filed Nov. 30, 2013 entitled METHOD AND APPARATUS FOR REPAIRING AND SEALING WOODEN DOOR AND WINDOW JAMBS which is hereby incorporated herein by reference in the entirety.

FIELD OF THE INVENTION

The present invention is related to the repair of door and window jambs and other exterior surfaces of a building that are susceptible to environmental elements or pests. The present invention more specifically relates to protective restoration covers and jamb shield guards made from water and environmentally resistant materials that are pre-dimensioned or that provide preformed grooves aligned along the cover to provide for a user to cut along the groove and snap off an excess portion of the cover to properly fit over and seal all or a portion of standard or non-standard sized door or window jamb, frame, or exterior trim. The protective restoration covers may further be included in a kit that provides for a homeowner to easily size the covers to the appropriate dimensions and perform the repair.

BACKGROUND OF THE INVENTION

In most homes wood is commonly used in the construction of door and window jambs, frames and exterior trim. The door or window jamb surrounds a door or window and affixes the frame of the door or window to a building. Stain or paint is used to seal the wood and over time the sealant may chip causing cracking and degradation of the wood. The degradation is unsightly and causes air gaps that allow cold air and rain from outside a building to enter causing drafts and increasing heating costs. The degradation also may cause rot and deterioration of the wood and structural elements of the building. While environmentally resistant thermoplastic materials are now more often used for door and window jambs, frames, trim and other exterior surfaces on newly built homes and other buildings, what is not known is a method to easily repair and seal degraded jambs, frames or other exterior trim surfaces. Currently, a common method to repair a door jamb is to replace the entire door, jamb and casing at a high cost. The present invention provides a way to keep older doors or windows and maintain the history and integrity of the architectural aesthetic of older structures without significant expense. Additionally the present invention provides a barrier from outside elements by creating a seal around any gaps or openings in the degraded wooden jamb, frame, or trim.

OBJECTS AND SUMMARY OF THE INVENTION

Door and window jambs that surround and support the door or window frames, or other exterior trim surfaces are commonly painted or stained wooden that degrade over time as paint and sealants chip away exposing the untreated wood to environmental elements and pests. The current method to repair deteriorating wooden door and window jambs or other exterior trim surfaces is to remove and replace the entire door or window along with wooden jamb. This process costs a considerable amount of money and takes a fairly significant amount of time to complete. Generally, this process is left to professionals in order to execute the construction and installation properly. Alternatively, a portion of the degraded wooden jamb may be removed using a chisel and is replaced with another piece of wood that is cut and inserted into the chiseled out portion of the jamb possibly causing gaps or an unsightly mismatch of finish where the two pieces do not fit perfectly together. The removal of a portion of the wooden jamb may take a considerable amount of time and labor as the jamb is chipped out piece by piece. The present invention saves significant time and money and allows a homeowner or others having limited technical knowledge to easily repair and seal door or window jambs or other exterior surfaces that have deteriorated over time.

The present invention is related to pre-fit protective covers that provide for a user to easily size and install the protective cover over a door jamb or other exterior surface to repair and seal degraded surfaces having chipped paint or stain. The protective covers are dimensioned to a standard size in width and length that is adequate for a large number of standard size door jambs and frames. The protective covers further provide a partially cut groove that is aligned at standard dimensions to provide for a user to cut along the groove and snap off an excess portion of the cover in order to use a properly sized piece to cover degraded door jambs that are smaller than the standard dimensioned cover. The present invention further provides pre-fit door jamb shield guards that may be installed to cover and seal only a portion of the door jamb that has deteriorated for example at the base of a door jamb which is a common area where the door jamb degrades over time.

The present invention further provides for protective covers to be used to cover window jambs, frames, and exterior trim. However, unlike the width of door jambs, window jambs and frames and exterior trim are of varying widths with very few standard sizes. For windows, the protective restoration covers are pre-dimensioned to available standard window sizes in width and in length. In this further embodiment of the present invention, the covers have a number of partially cut grooves aligned along the length of the protective cover and/or the width of the cover to provide for a portion of the cover that is closest to the nearest appropriate dimension to be removed to properly size the protective cover in length and width to an adequate dimension for a particular window jamb or frame to cover and seal the surface from the environment. Any number of grooves may be provided along the exterior surface of the cover with any remaining grooves providing a decorative element to the window cover. When the appropriate dimension is chosen, a utility knife is run along the groove and because the depth of the groove extends almost through the thickness of the protective cover, the excess piece is easily snapped off and removed from the cover exactly along the groove leaving a smooth uniform edge.

The protective door and window jamb covers are made from a free foam cellular polyvinyl chloride (PVC) trim board or other simulated wood or composite that is of a water and environmentally resistant plastic material that is free of voids, holes, cracks, foreign inclusions and other defects. The grooves may be formed by routing along the length of the restoration cover at the standard dimensions most commonly used for the width of door jambs, or by routing a number of grooves at every ¼ of an inch or every ½ inch to provide for the proper amount of cover to be removed to fit jambs, frames and trims of non-standard dimensions. Additional grooves may be formed at the top or bottom of the cover to provide for the cover to be dimensioned to the proper length for a particular door or window jamb. The covers are formed with a 90° right angle extension along the length of the cover to align the cover and provide a perpendicular surface that abuts and seals along the face of the jamb, frame or exterior trim. The cover is secured in place using an adhesive, nails or other fasteners. The covers may be painted or stained to match the coloring of the jamb, frame or exterior trim. The restoration covers may further be manufactured through an extrusion or molding process to form the covers with the grooves at appropriate dimensions to properly fit over standard and non-standard jambs, frames and exterior trim of a building. Other manufacturing processes to form the covers are within the scope of the present invention.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

DETAILED DESCRIPTION OF THE DRAWINGS

Figure 1:
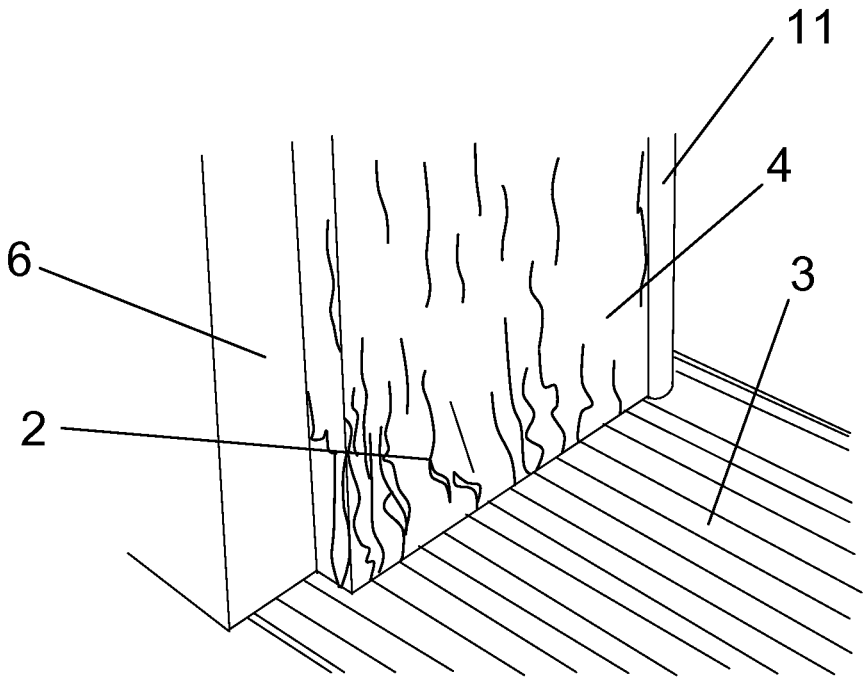
FIG. 1 is an illustration of a degraded portion of a door jamb.
Figure 2:
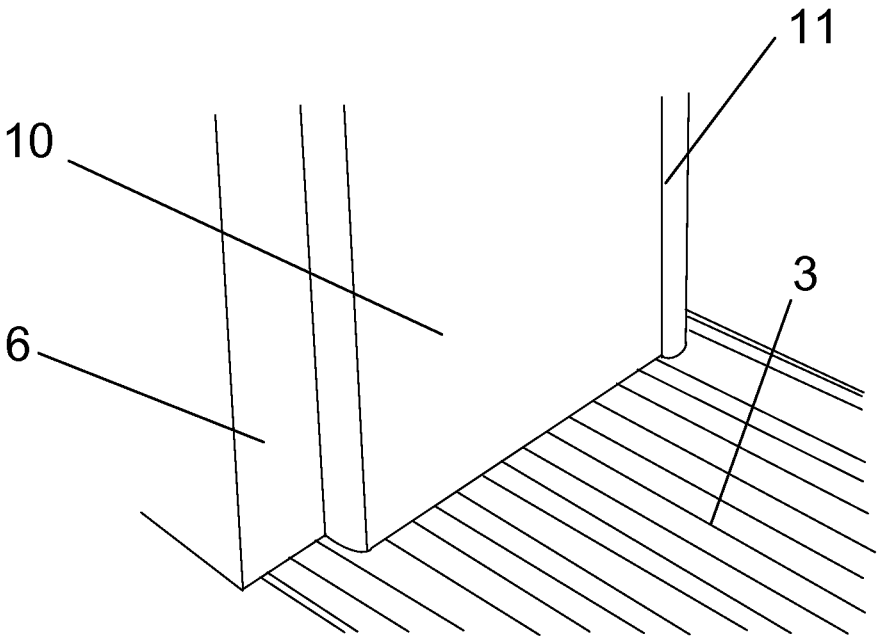
FIG. 2 is a perspective view an embodiment of the protective restoration cover of the present invention installed on the degraded door jamb of FIG. 1.
Figure 3A:
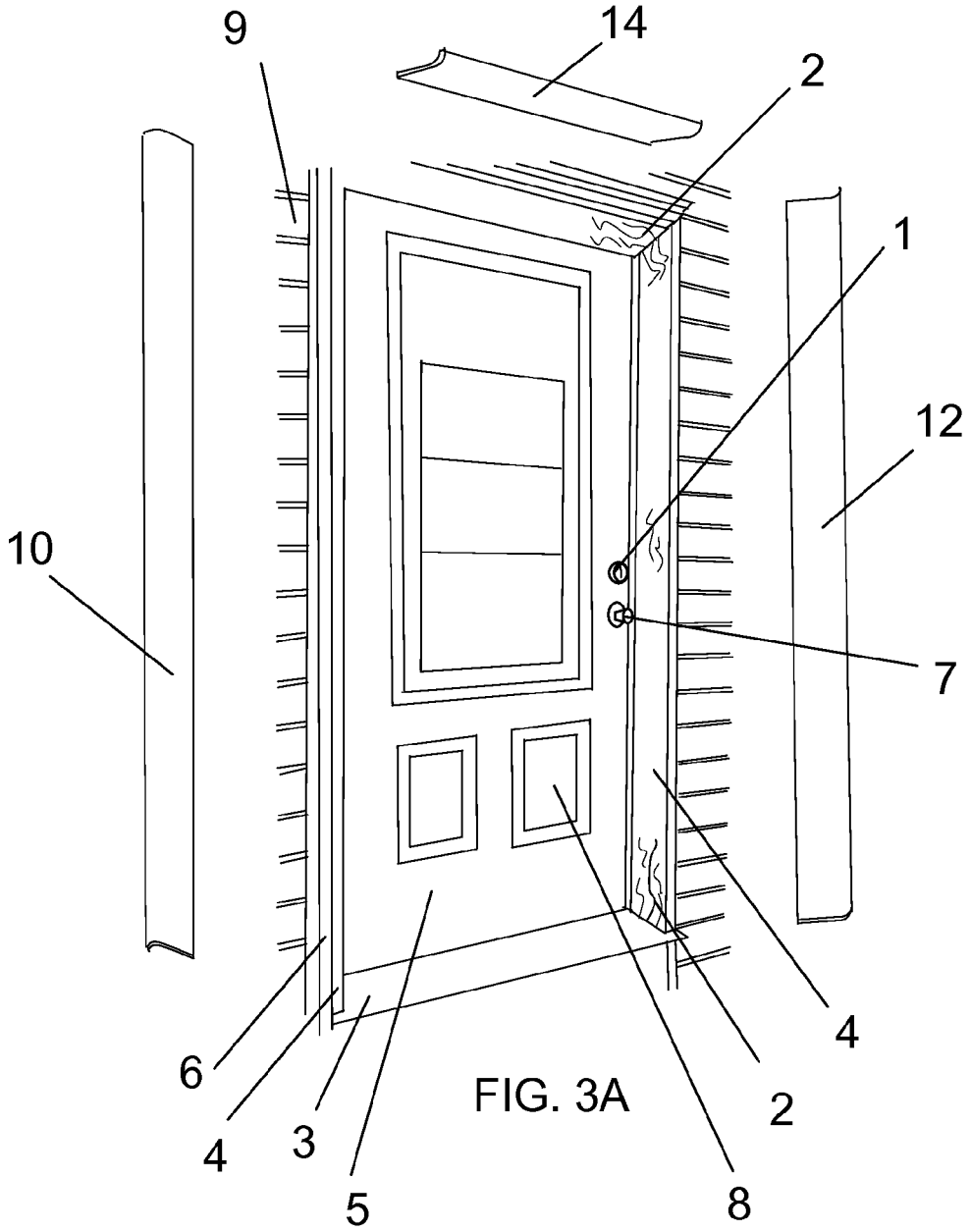
FIG. 3A is a perspective view of a degraded door jamb and the vertical and horizontal protective covers of the present invention.
Figure 3B:
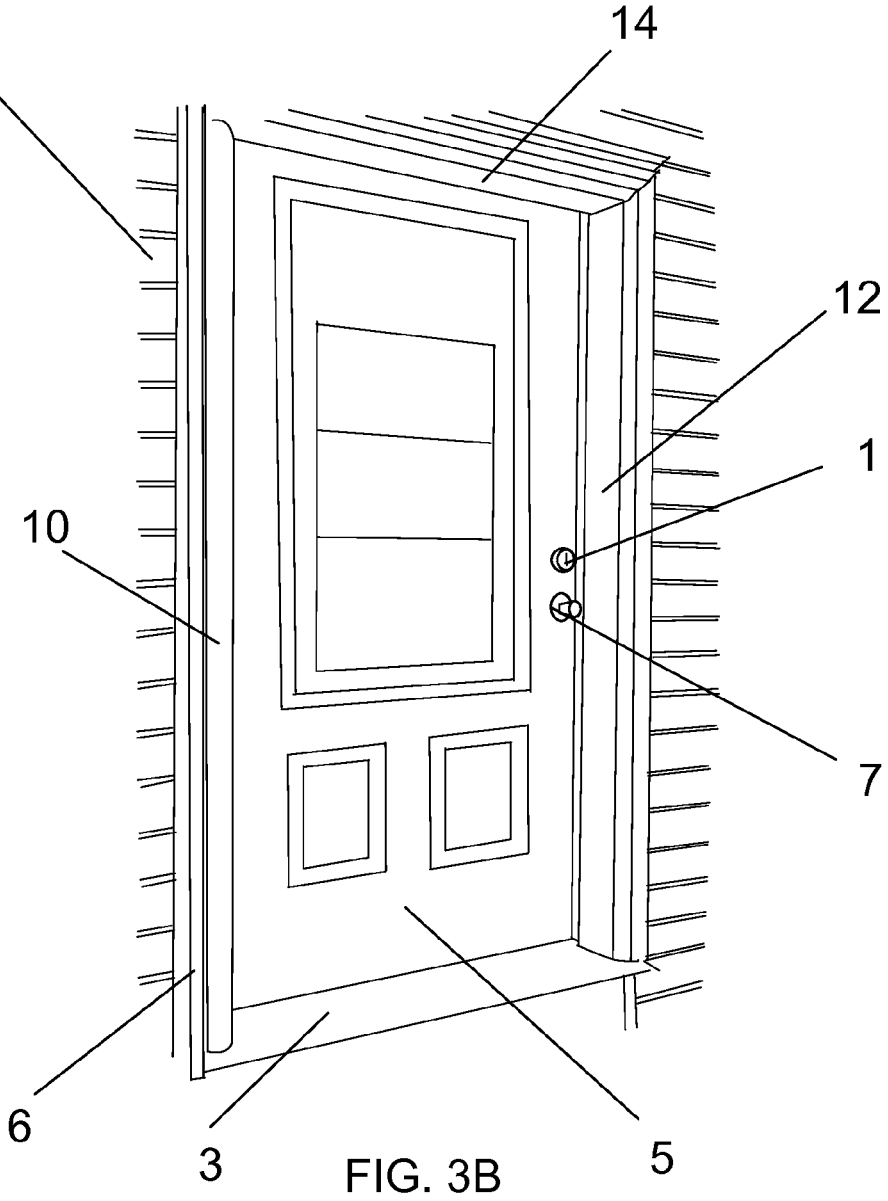
FIG. 3B is a perspective view of the protective covers of the present invention installed to the degrade door jamb of FIG. 3A.

Over time, paint 2 or sealant on the exterior surface of a door jamb 4 may chip and peel, as shown in FIG. 1, leaving the door jamb 4 susceptible to degradation by wind, rain, cold, and other environmental elements or pests. Particularly at the base of the door jamb 4 along the threshold 3 the paint 2 may peel. As shown in FIG. 2, the present invention provides a pre-dimensioned protective restoration cover 10 to be installed over the door jamb 4 to seal along the threshold 3 and weather stripping 11 to protect and prevent further degradation of the exterior surface of the door jamb 4. The pre-dimensioned protective covers of the present invention are cut or formed to standard door and window jamb lengths and widths and in further embodiments may be easily modified to fit and cover smaller sized jambs, frames or exterior trim using unique preformed grooves 35 that make the cover easy to re-size so that a repair can be performed by any homeowner of limited technical ability. For a door, the protective covers, as shown in FIG. 3A, are pre-dimensioned to a standard size as a left side vertical cover 10, a right side vertical cover 12 and a top horizontal cover 14. The pre-dimensioned protective covers 10, 12 and 14 are installed along each exterior surface of the left and right door jamb and the upper jamb over the door jamb using an adhesive, nails, brads, or other fasteners to completely seal the cover to the jamb 4. The protective door jamb covers are shown installed to the door jamb 4 in FIG. 3B. The cover 12 is of a minimal thickness that when installed provides adequate space and clearance for a lock 1 or door knob 7 to not interfere with the cover 12 when opening or closing the door 5. The covers may be painted or stained to match other exterior trim 6 or complement the exterior walls 9 of the building.

Figure 4:
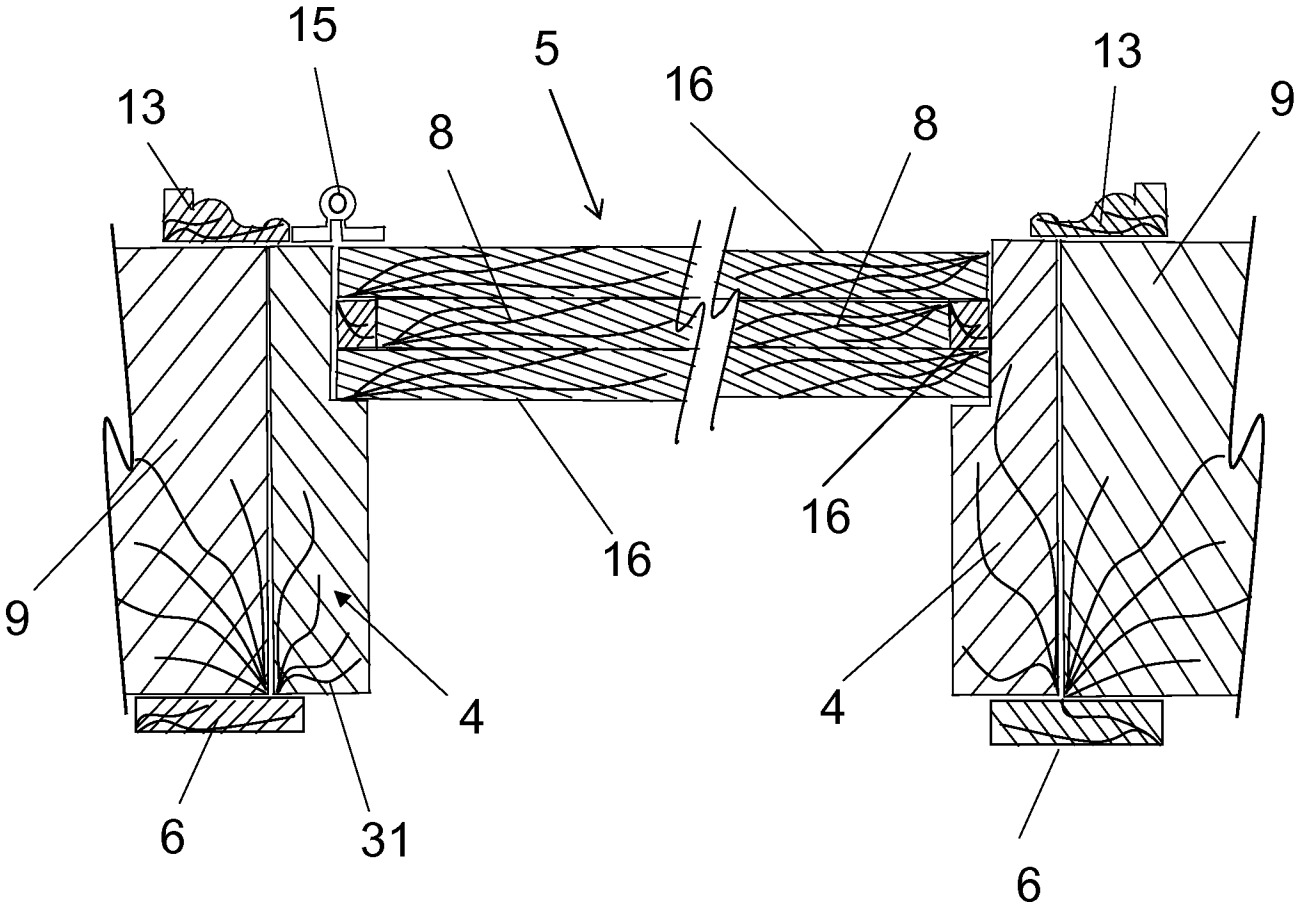
FIG. 4 is a cross-sectional view of a door, door jamb, exterior trim and wall of a building.
Figure 5:
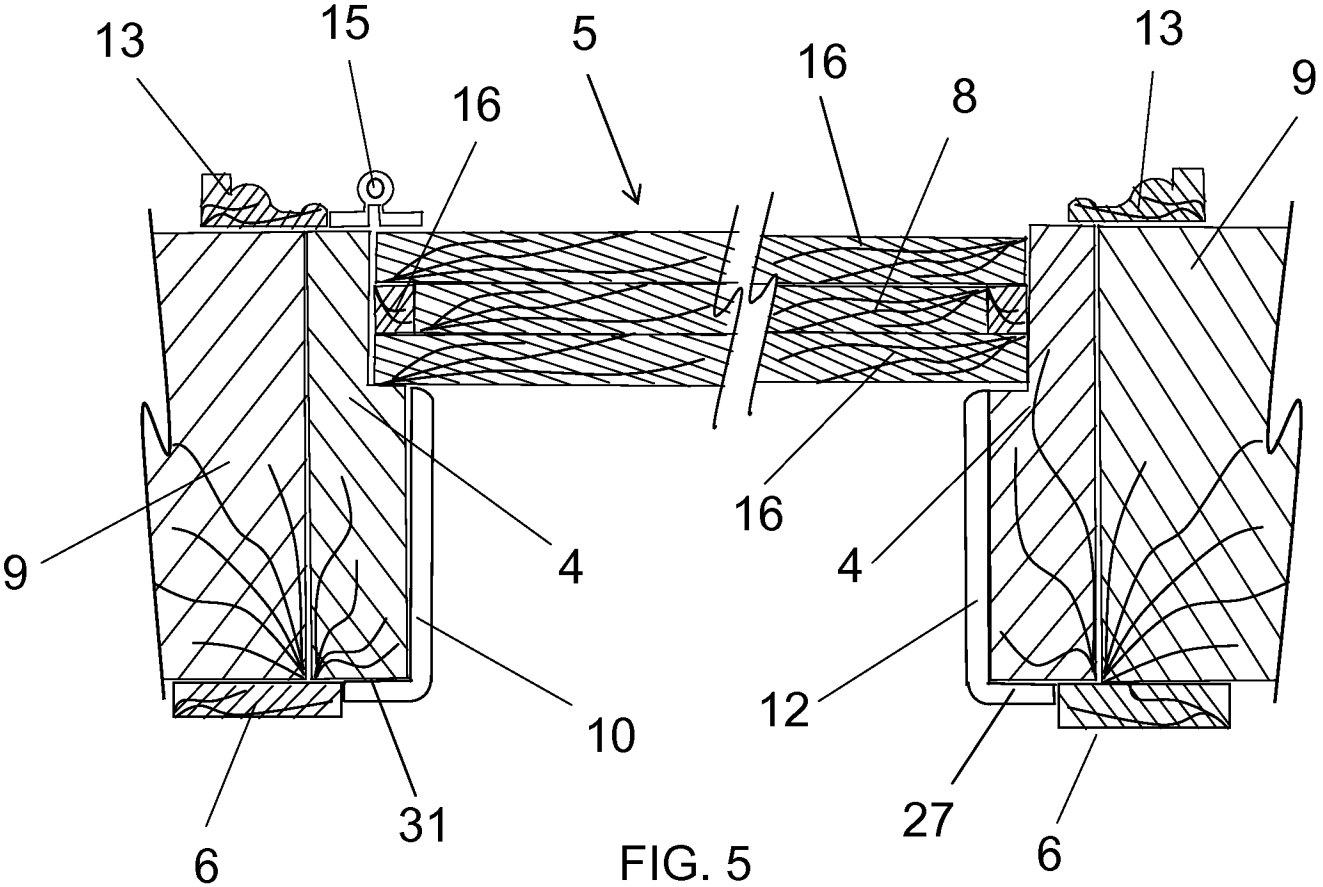
FIG. 5 is a cross-sectional view of a door, door jamb, exterior trim and wall of a building with the protective covers of the present invention installed over the door jamb.
Figure 6A:
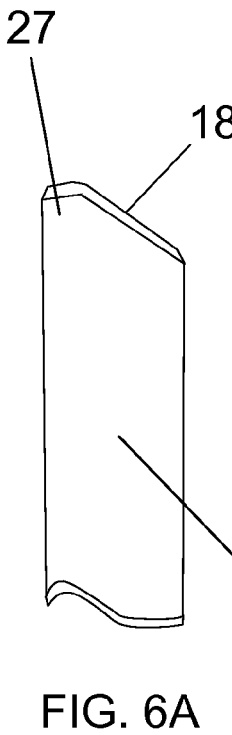
FIG. 6A is a perspective view of a portion of a vertical protective cover of the present invention.
Figure 6B:
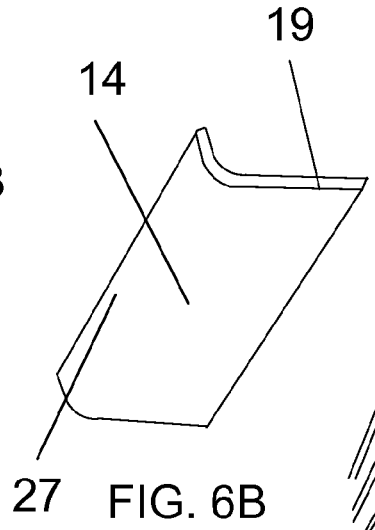
FIG. 6B is a perspective view of a horizontal protective cover of the present invention.
Figure 6C:
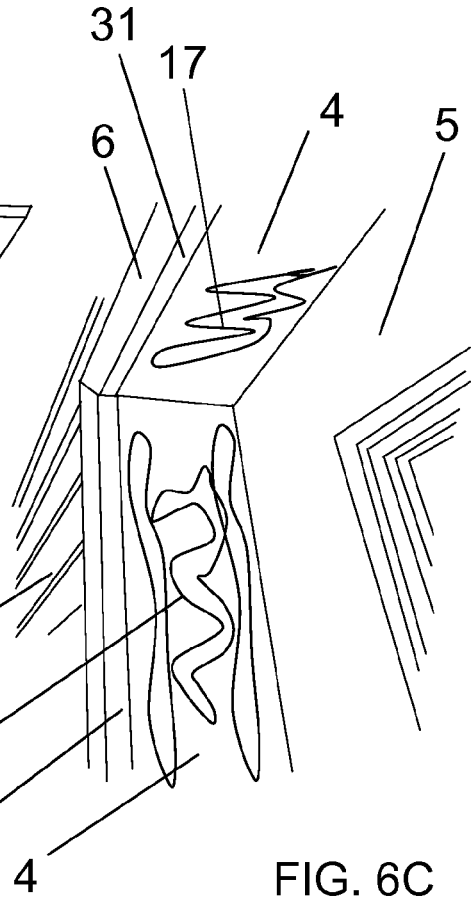
FIG. 6C is a perspective view of a portion of a degraded door jamb with adhesive.
Figure 6D:
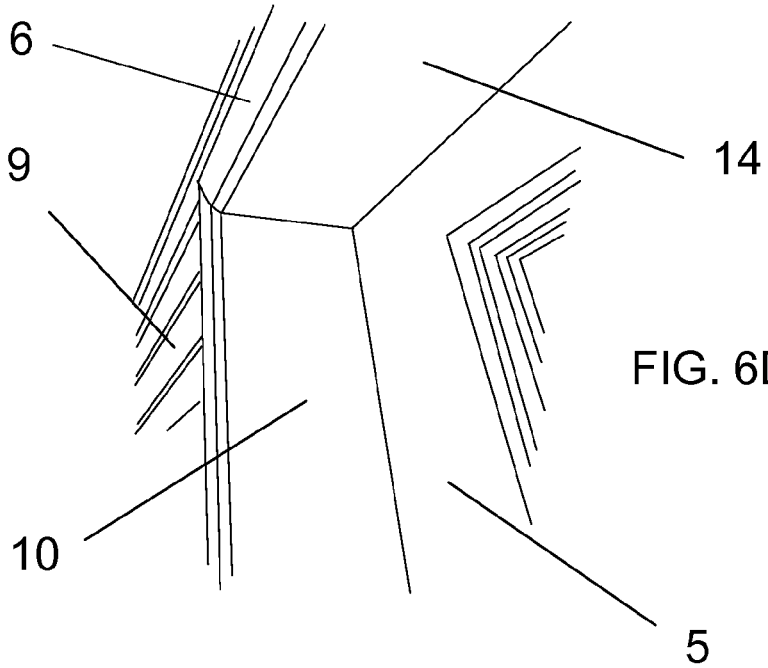
FIG. 6D is a perspective view of the protective restoration covers of the present invention installed to the degraded door jamb of FIG. 6C

As shown in FIG. 4, a door jamb 4 abuts an exterior wall 9 of a building that surrounds an exterior door 5. On the face 31 of the door jamb 4, a casing 6 or exterior trim extends over the door jamb 4 and seals over the shell of the exterior wall 9. The exterior surfaces of the casing 6 and door jamb 4 are susceptible to wear and commonly as wood products, must be periodically repainted or stained to seal the door 5 and trim 6 from the elements. The door 5 may have a door frame 16 holding glass windows or door panels 8 with a hinge 15 adjacent an interior casing 13 affixing the door 5 to the door jamb 4. The interior casing 13 or trim is installed along the door jamb 4 and wall 9. A first embodiment of the pre-dimensioned protective restoration covers 10 and 12 are installed along each exterior surface of each door jamb 4 to the left and right of the door 5 using an adhesive, nails, brads, or other fasteners to completely seal the cover to the jamb 4 as shown in FIG. 5. A right angle extension 27 of the protective covers 10 and 12 extends over the face 31 of the door jamb 4 to abut along the exterior trim 6.

As shown in FIGS. 6A-6D, a horizontal protective cover 14 is installed to the upper surface of the door jamb 4 with the right angle extension 27 of the horizontal cover 14 aligning along the face 31 of the upper door jamb 4. To install the protective cover 14, a suitable amount of the adhesive 17 is applied using a caulking gun or other tool along a portion of the upper door jamb 4. The adhesive 17 may be applied linearly along the length of the jamb 4 and then in a zigzag pattern. It is important that the application of adhesive 17 is adequate to prevent the protective cover from coming loose over time, although an excessive amount is not needed where the excess will spread out of the cover and may be unsightly when dried. Adhesive 17 is then applied to the left vertical surface of the door jamb 4 and the left vertical protective cover 10 is installed. Each section of the jamb 4 may be done separately. Alternatively, the protective covers may be affixed to the surfaces of the door jamb 4 using brads, nails, or other fasteners.

Figure 7A:
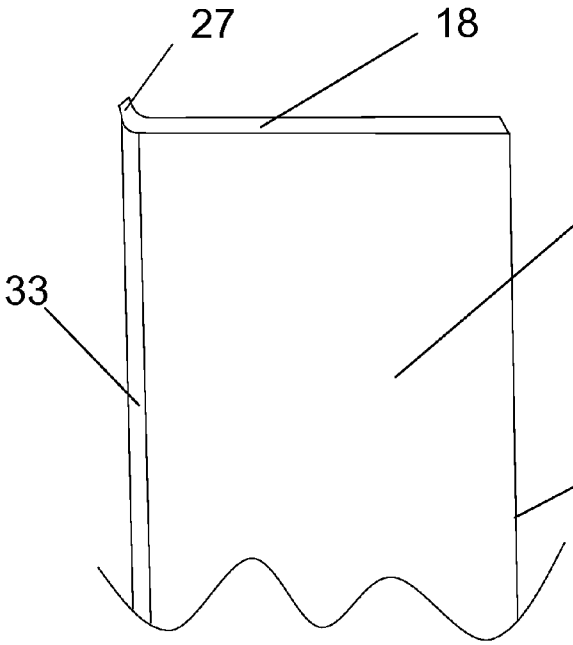
FIG. 7A is an elevation view of an upper portion of an embodiment of the vertical protective cover of the present invention.
Figure 7C:
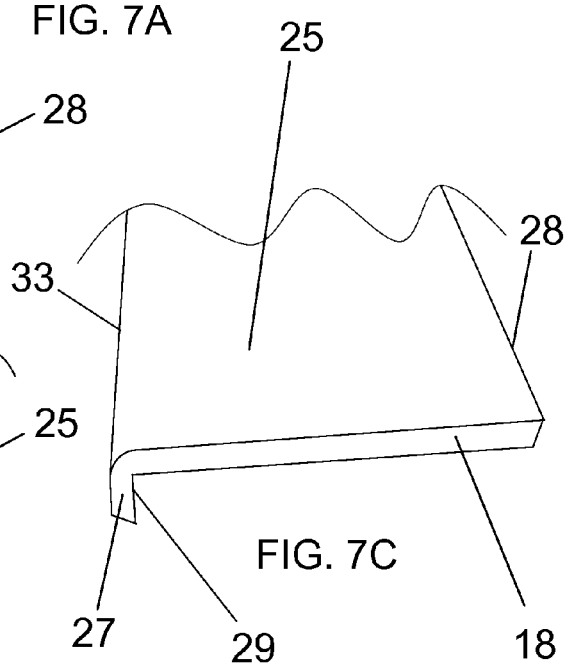
FIG. 7C is a perspective end view of a portion of the embodiment of the vertical protective cover of the present invention.
Figure 7B:
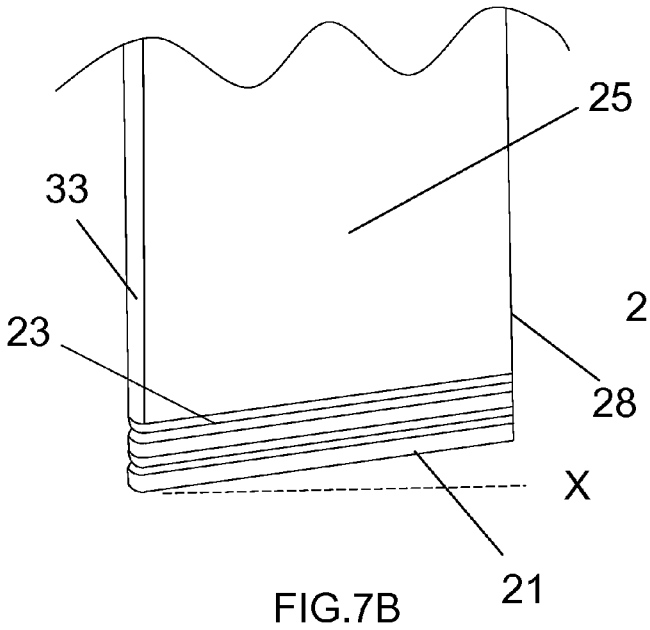
FIG. 7B is an elevation view of a lower portion of the embodiment of the vertical protective cover of the present invention.

The protective cover has a straight uniform rear edge 28 substantially perpendicular to the axis X, as shown in FIGS. 7A-7C. Each upper end surface 18 of the left and right vertical covers 10 and 12 are formed at a 45° angle to mate with 45° angles formed on both end surfaces 19 of the upper horizontal protective cover 14 for easier alignment and installation. The left and right vertical covers 10 and 12 have an angled base 21 to accommodate the door threshold 3. The base 21 of the cover is cut at an angle in a range of 5°-10° and more specifically at an angle of approximately 6° from the axis X which is perpendicular to the rounded edge 33 of the protective cover as shown in FIG. 7B. The angle provides for the base 21 to be fitted to the door threshold 3 and be sealed with adhesive to prevent precipitation from seeping behind the protective cover and damaging the wood below. Grooves 23 may be routed in parallel to the angled base 21 and somewhat perpendicularly to the length of the cover to provide for the removal of excess material for door jambs of smaller lengths. Similarly, to the grooves that are cut and snapped off to adjust the width, the base grooves 23 may provide for material to be easily removed from the base in order to fit the cover properly over the jamb 4. The grooves 23 extend along the rounded edge 33 and right angled extension 27.

The protective covers have a flat exterior surface 25 that extends from the rear edge 28 to the rounded edge 33 that forms the 90° right angle extension 27 along the length of the cover. The right angle extension provides a perpendicular interior surface 29 as shown in FIG. 7C, that abuts and seals along the face 31 of the jamb 4 or exterior facing surface of a frame or exterior trim to provide support for the cover to be easily aligned and secured in place using the adhesive 17 or other fastener. The edge 33 along the extension 27 is rounded and smooth to prevent sharp edges that may catch or be damaged. After installation, any gaps between the protective covers 10, 12, and 14 and the threshold 3 or casing 6 should be filled with the adhesive 17 to completely seal the door jamb 4. All excessive adhesive 17 should be removed and the protective cover surfaces 25 may be cleaned and painted or stained to match the exterior walls 9 or trim 6 of the building.

Figure 8:
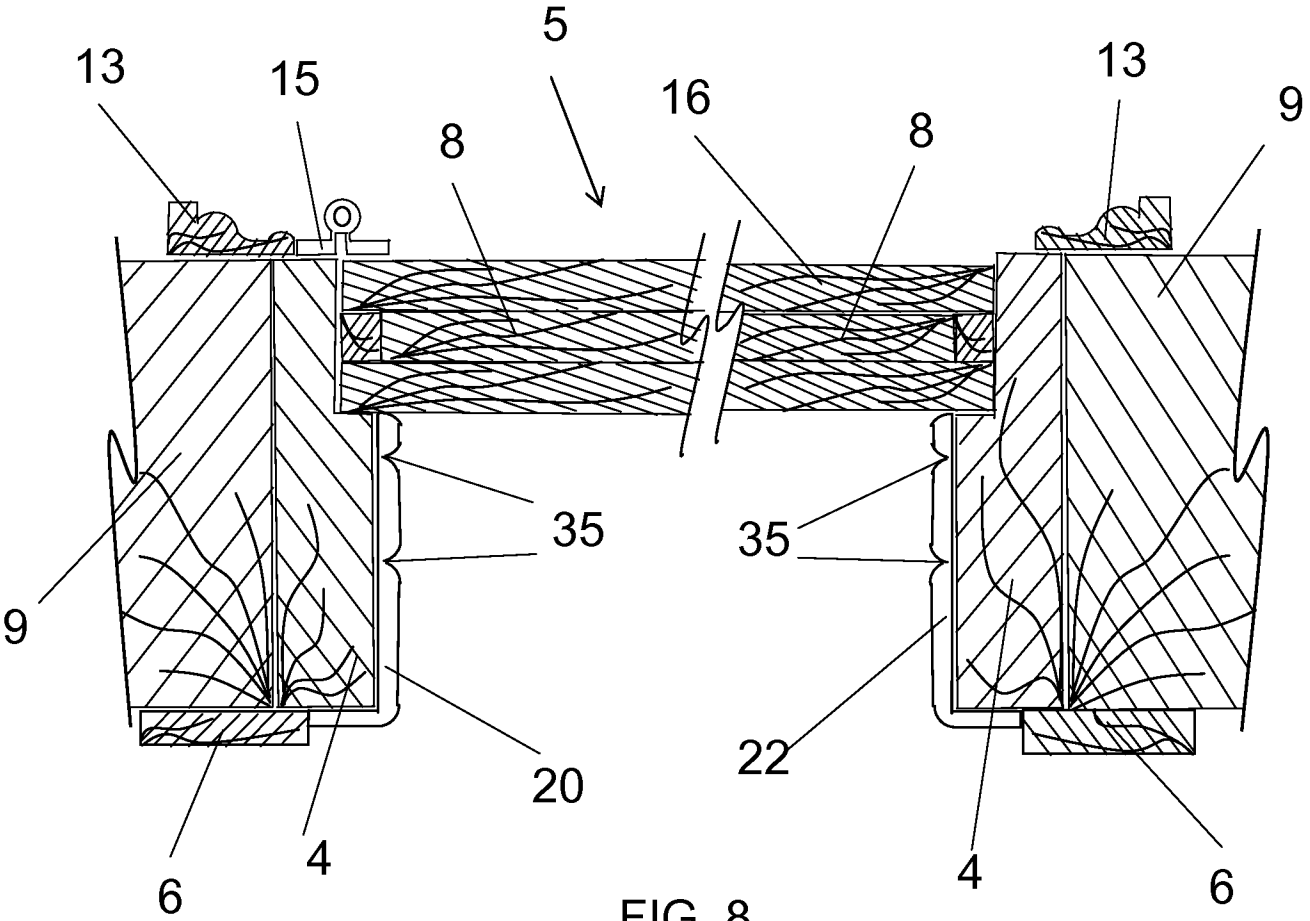
FIG. 8 is a cross-sectional view of a door, door jamb, exterior trim and wall of a building with the protective restoration covers of the present invention installed.
Figure 9A:
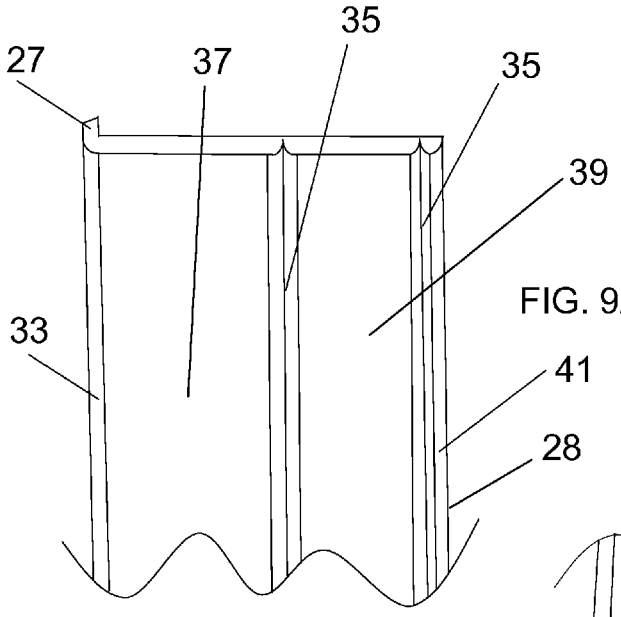
FIG. 9A is an elevation view of an upper portion of a further embodiment of the vertical protective cover of the present invention.
Figure 9C:
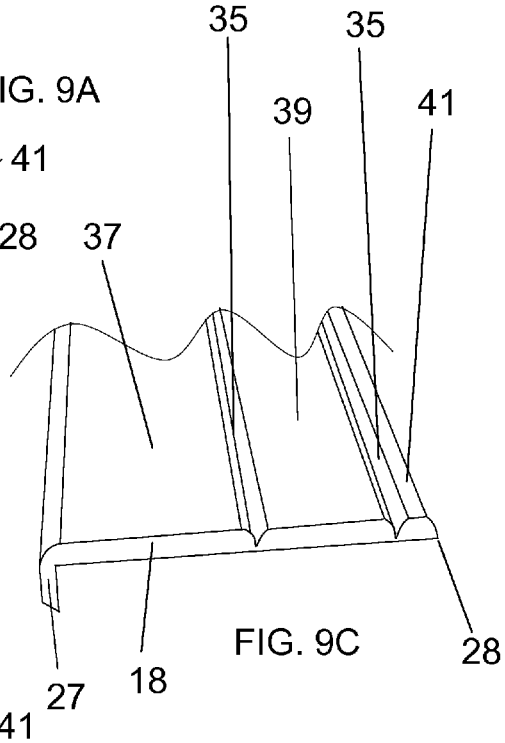
FIG. 9C is a perspective end view of a portion of the further embodiment of the vertical protective cover of the present invention.
Figure 9B:
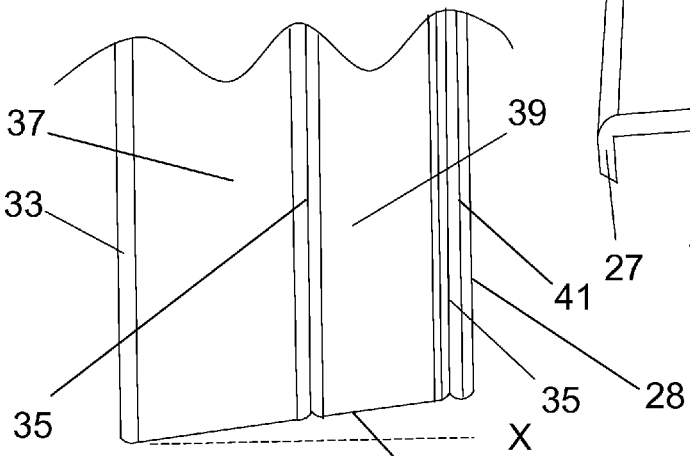
FIG. 9B is an elevation view of a lower portion of the further embodiment of the vertical protective cover of the present invention.

A further embodiment of the present invention allows the user to custom fit the present invention to non-standard or smaller standard sized door or window jamb widths or other exterior trim surfaces. In this embodiment, one or more grooves 35 are formed or routed along the width of the protective covers 20 and 22 at distances that correspond to one or more additional standard sizes for a door jamb 4, as shown in FIG. 8. The grooves 35 are formed in the cover with rounded or other aesthetic designs. For a standard size door jamb the grooves 35 provide an unobtrusive element along the length of the jamb as shown in FIGS. 9A-9C forming a first surface 37, a second surface 39 and a third surface 41 from the exterior surface 25 of the cover. Other features such as the right angle extension 27, the rounded edge 33, the surface end 18 formed as a 45° angle to mate with other restoration covers and the base 21 formed at a 6° angle to accommodate the angle of the threshold 3 may all be elements of this further embodiment of the protective covers.

Figure 10A:
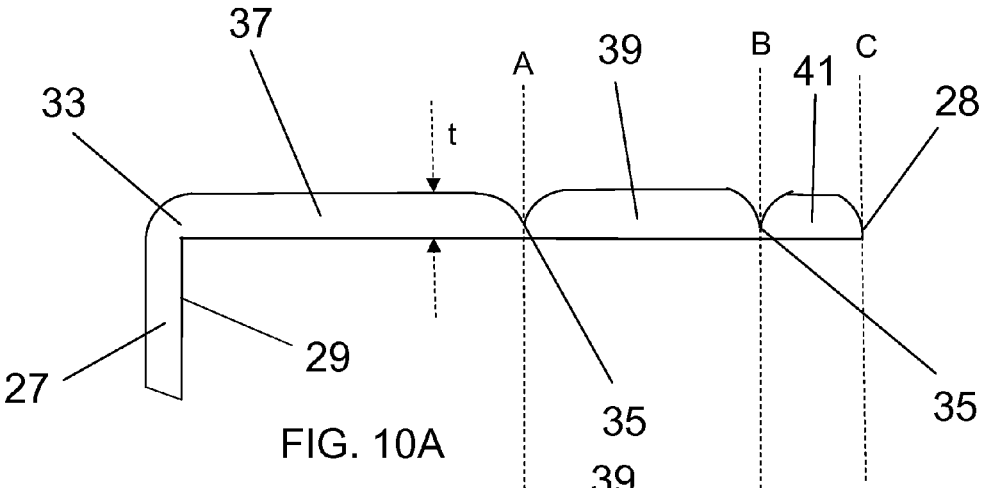
FIG. 10A is an end view of a protective restoration cover of the present invention.
Figure 10B:
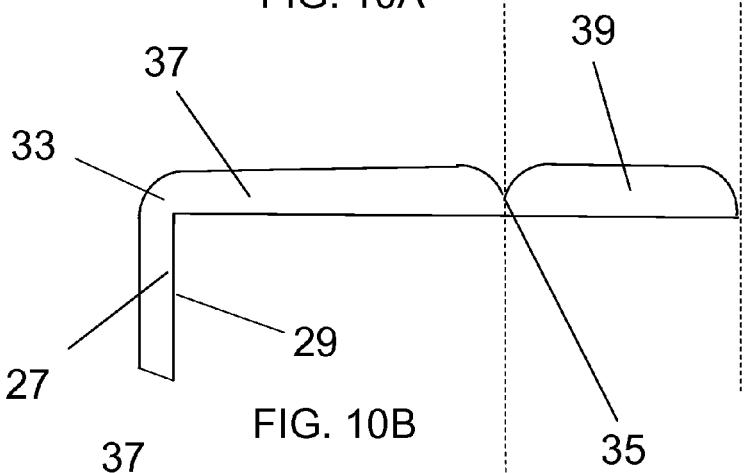
FIG. 10B is an end view of the protective restoration cover shown in FIG. 10A cut to a shorter width than shown in FIG. 10A.
Figure 10C:
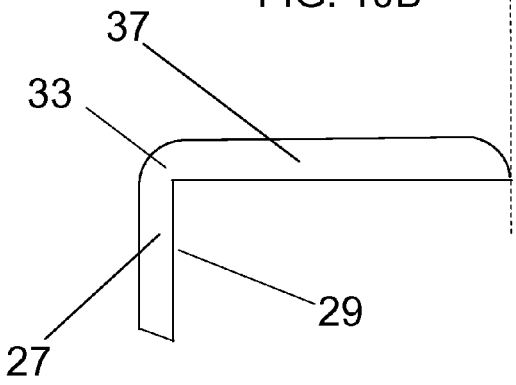
FIG. 10C is an end view of the protective restoration cover shown in FIG. 10A cut to a shorter width than shown in FIG. 10B.

As shown in FIGS. 10A-10C, the protective restoration cover is dimensioned at a largest standard size C and the grooves 35 are aligned at a smaller standard size B and an even smaller standard size A to provide for a single cover to be used to seal door jamb widths of three different standard sizes. Any number of grooves 35 can be routed into the cover to accommodate jambs and trim of various dimensions for doors and windows in both commercial and residential buildings. The thickness t required for the restoration cover does not need to be more than a minimal thickness to seal adequately and structurally support the protective cover against the door jamb 4. The thickness may be in a range from 1/16 inch to 7/16 inch taking into account the space required to accommodate a hand turning a doorknob 7 or turning a key in a lock 1. For smaller width jambs, the cover can be cut through the groove using a utility knife-like tool and then the excess material can be snapped off. The rigidity of the composite material that forms the protective cover provides for the excess material to cleanly break along a break point of the groove to form a uniform edge along the cover.

Figure 11:
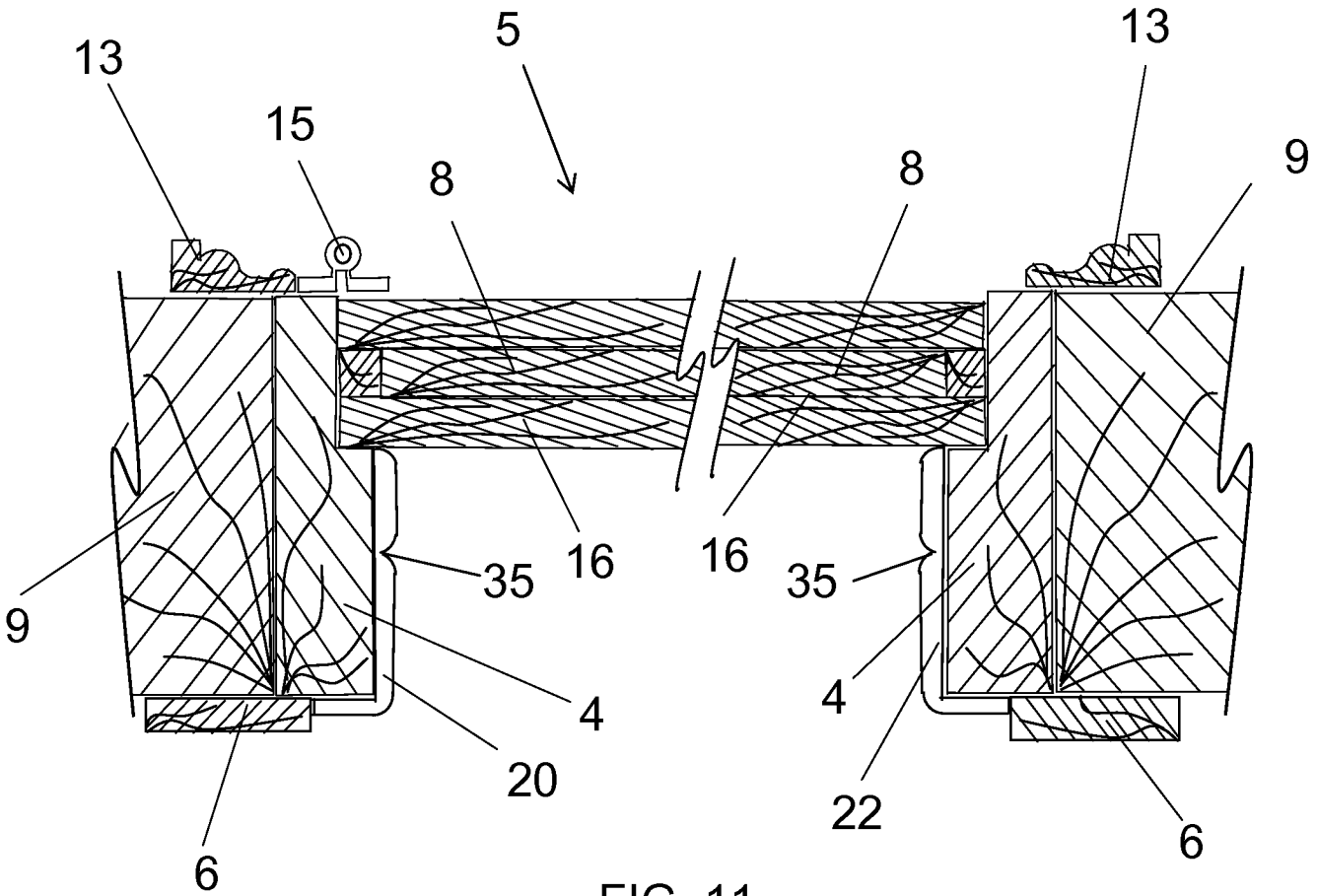
FIG. 11 is a cross-sectional view of a door, exterior trim and wall of a building with a door jamb with a shorter width than the door jamb of FIG. 8 with the protective restoration covers of the present invention installed.
Figure 12:
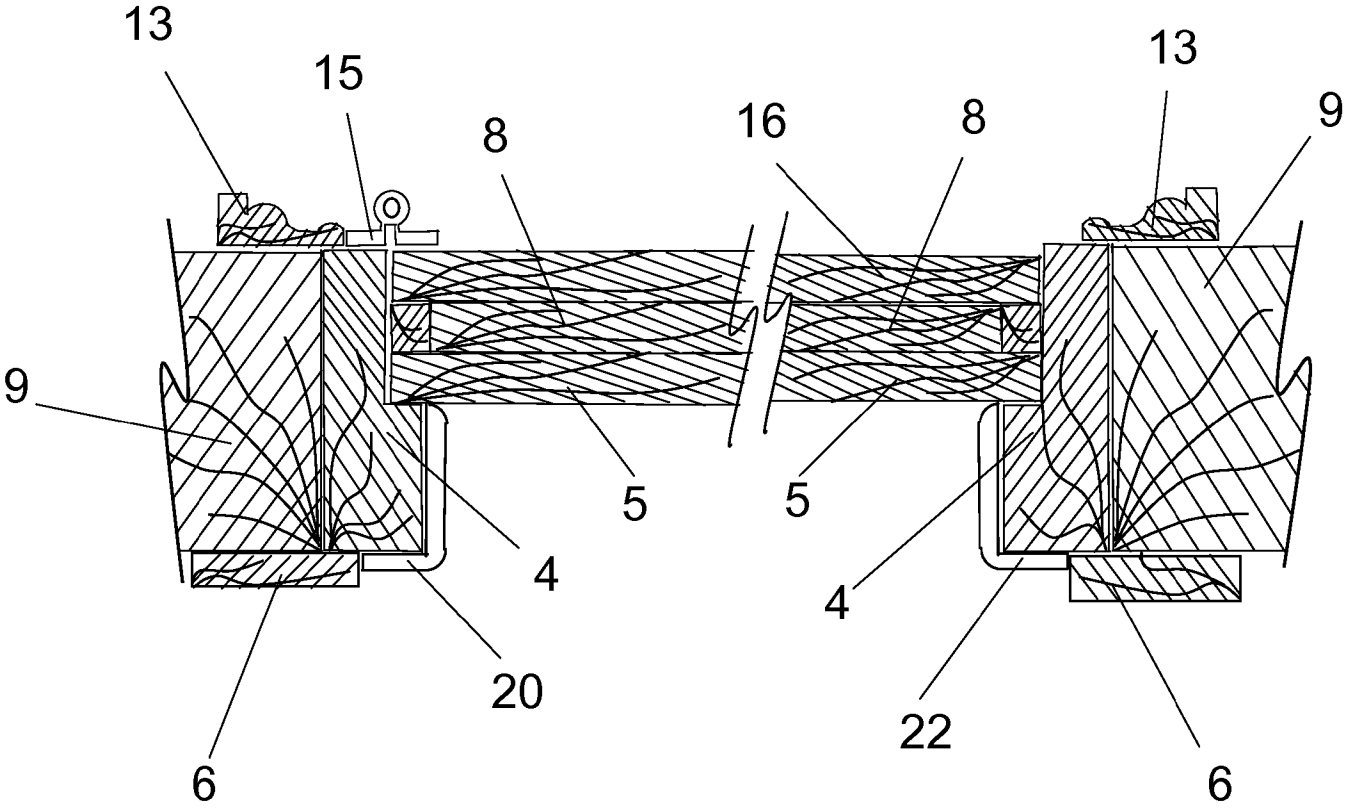
FIG. 12 is a cross-sectional view of a door, exterior trim and wall of a building with a door jamb with a shorter width than the door jamb of FIG. 11 with the protective restoration covers of the present invention installed.

As shown in FIG. 11, to fit a smaller standard width degraded door jamb 4, the protective covers 20 and 22 are cut along the groove 35 at the standard size B using a utility knife. The excess material 41 is then snapped off and removed for the cover. The newly dimensioned piece is then installed to the door jamb 4 using adhesive 17. For an even smaller standard width door jamb 4 the protective covers 20 and 22 are cut along the second groove 35 at the standard size A and the excess material at 41 and 39 are snapped off to fit the smaller standard size as shown in FIG. 12. In this manner the same cover can be pre-dimensioned and grooved to fit door jambs of different standard sizes. The protective covers as shown wrap around the jamb 4 and extend to the exterior casing 6 to shield the wooden jamb from weather and pests.

Figure 13:
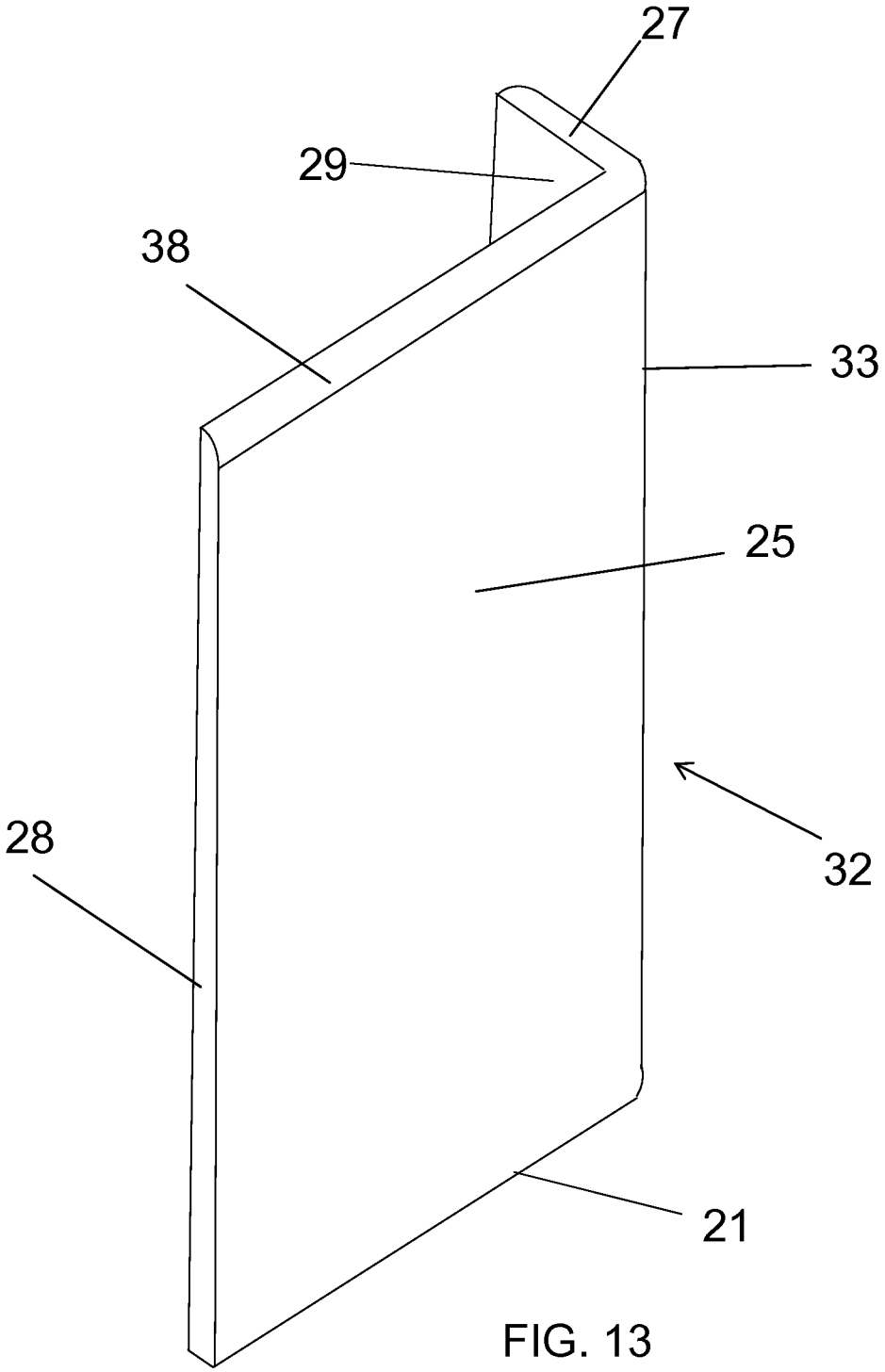
FIG. 13 is a perspective view of a further embodiment of the protective restoration cover referred to herein as a jamb shield guard that covers only a portion of a doorjamb.
Figure 14A:
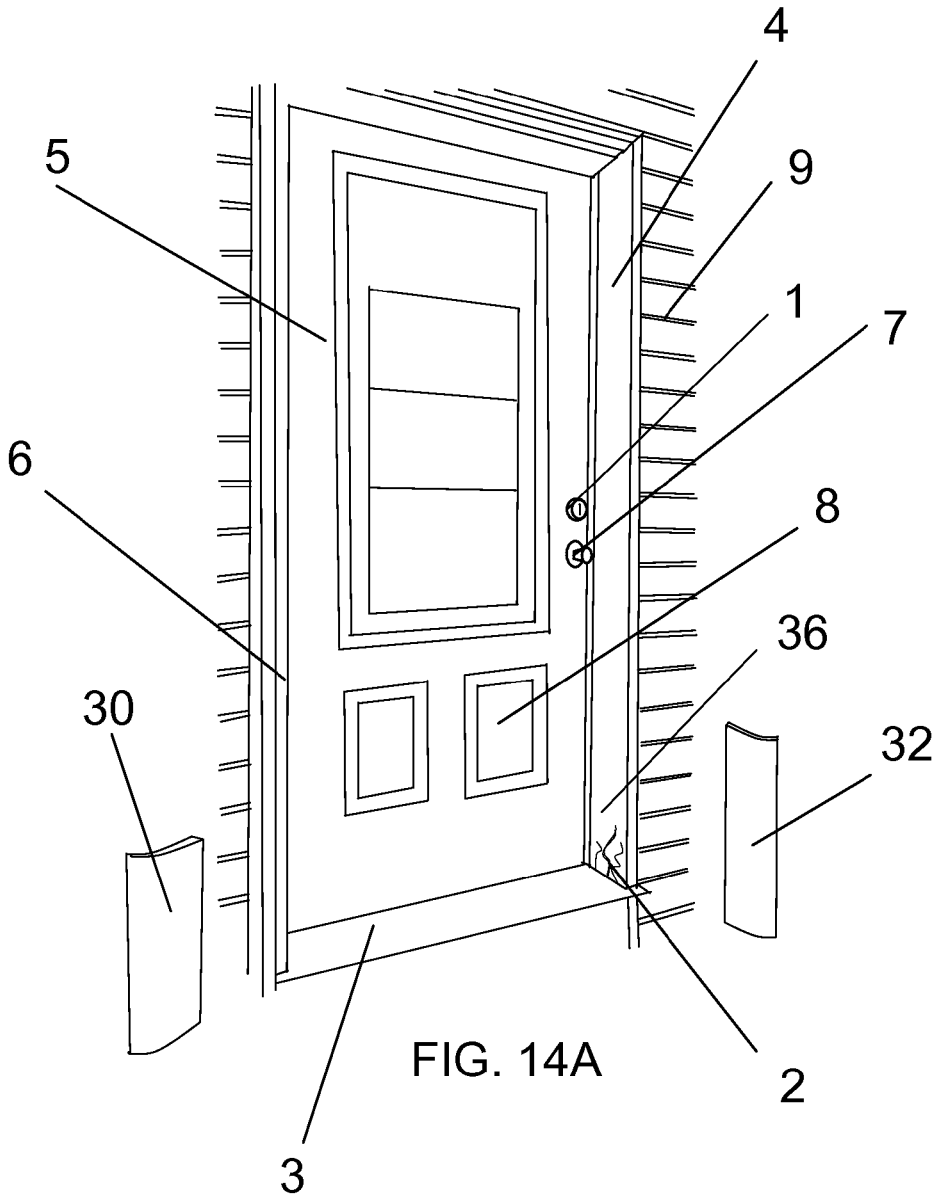
FIG. 14A is a perspective view of the embodiment of the jamb shield guards of FIG. 13 and a door with degraded door jambs.
Figure 14B:
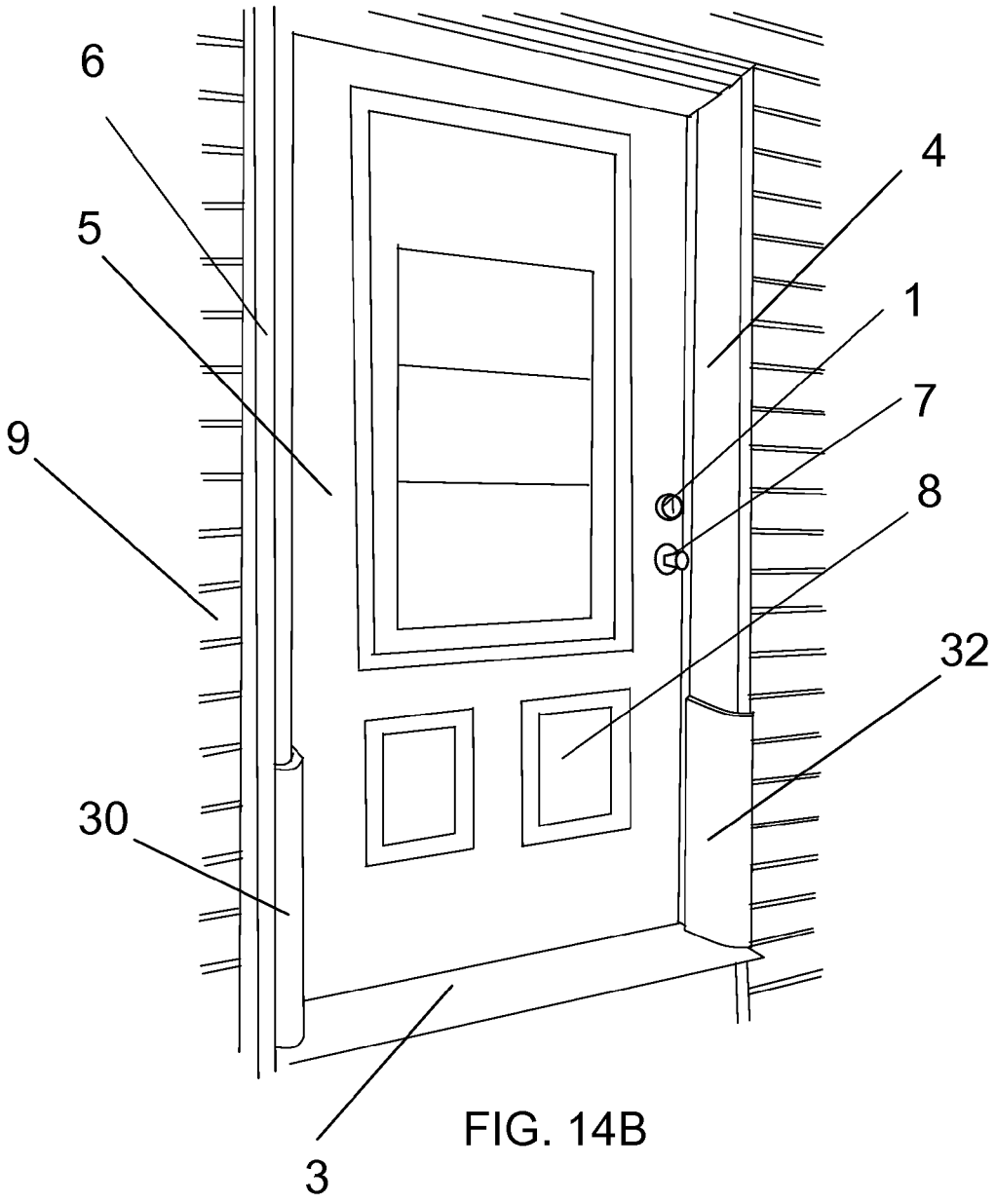
FIG. 14B is a perspective view of the embodiment of the door with degraded door jambs with the jamb shield guards installed.

In a further embodiment, the present invention allows for a user to use the protective restoration cover to cover a smaller portion of a door jamb 4 rather than the entire door jamb. The restoration cover sections or jamb shield guards 30 and 32 are in a range of 6 inches to 30 inches long and more preferably 12 inches in length as shown in FIG. 13. The base 21 of the shield guard is cut at approximately 6° angle from the axis X as previously described to have the shield guard securely fit to the threshold 3 and be sealed with adhesive 17 to prevent precipitation from seeping behind the restoration cover and damaging the wood below. The top edge 38 is rounded or angled and extends along the right angle extension 27 to deflect any precipitation away from the building. Similarly, to the full protective covers, the edge 33 from the front surface 25 is rounded to the extension 27 with the rear interior surface 29 of the extension 27 wrapping around the face 31 of the door jamb 4 providing for the alignment and sealing of the jamb shield guard to the base of the door jamb 4. As shown in FIG. 14A, a left jamb shield guard 30 and a right jamb shield guard 32 is provided for the lower portion 36 of each door jamb 4 where higher degradation and pealing of the paint or stain is common. The lower portion 36 of the door jamb 4 is cleaned and any loose paint chips are removed and adhesive 17 is applied to the lower portion 36. Each of the left and right jamb shield guards 30 and 32 are then aligned and installed to cover and seal the lower portion 36 of the door jamb 4 as shown in FIG. 14B. The exterior surface 25 of the shield guards 30 and 32 are primarily flat and can be of any color to match existing trim or be painted or stained.

Figure 15A:
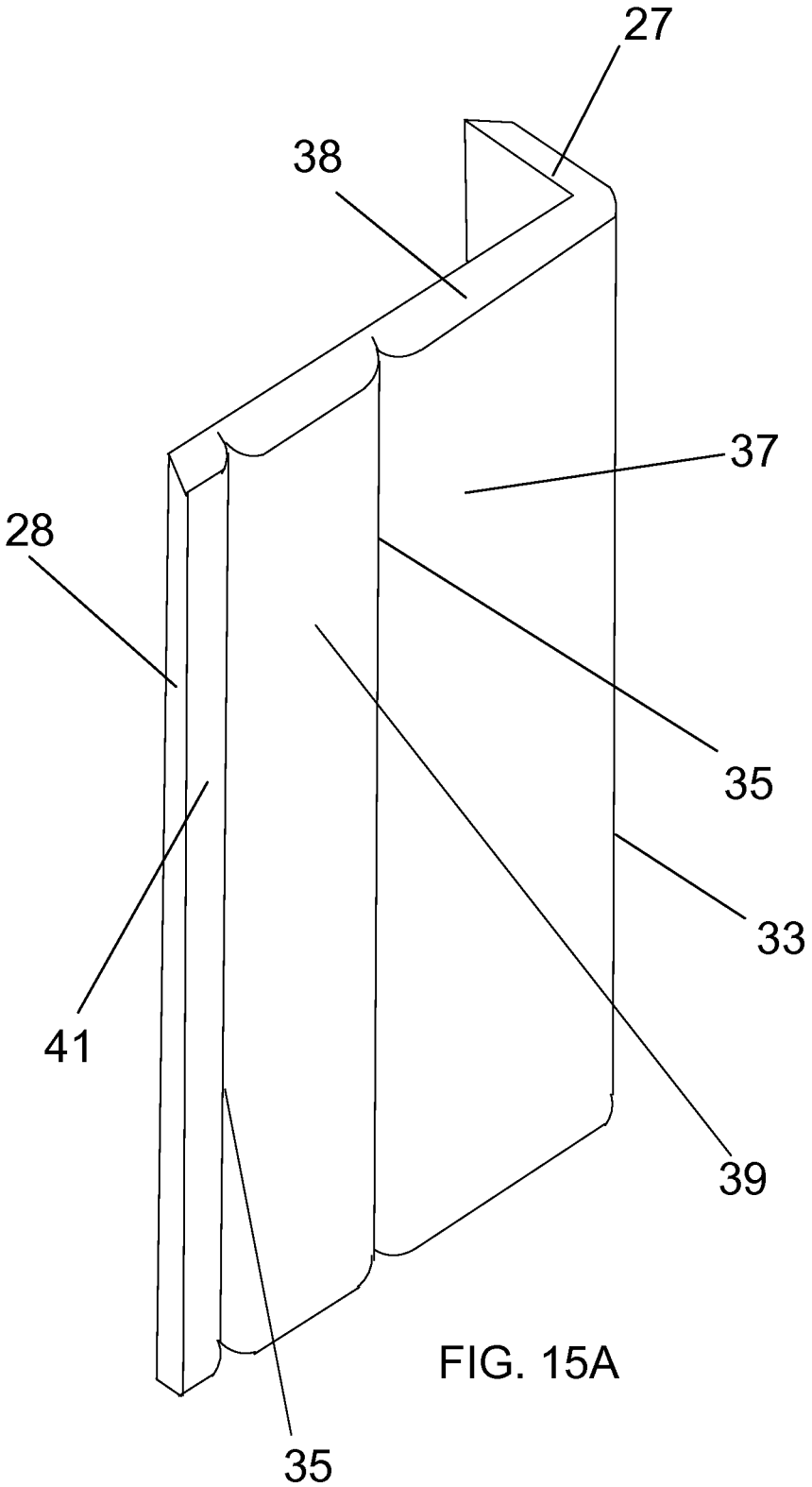
FIG. 15A is a perspective view of another embodiment of the protective restoration covers referred to herein as a jamb shield guards that cover only a portion of a door jamb with grooves at different pre-dimensioned widths.
Figure 15B:
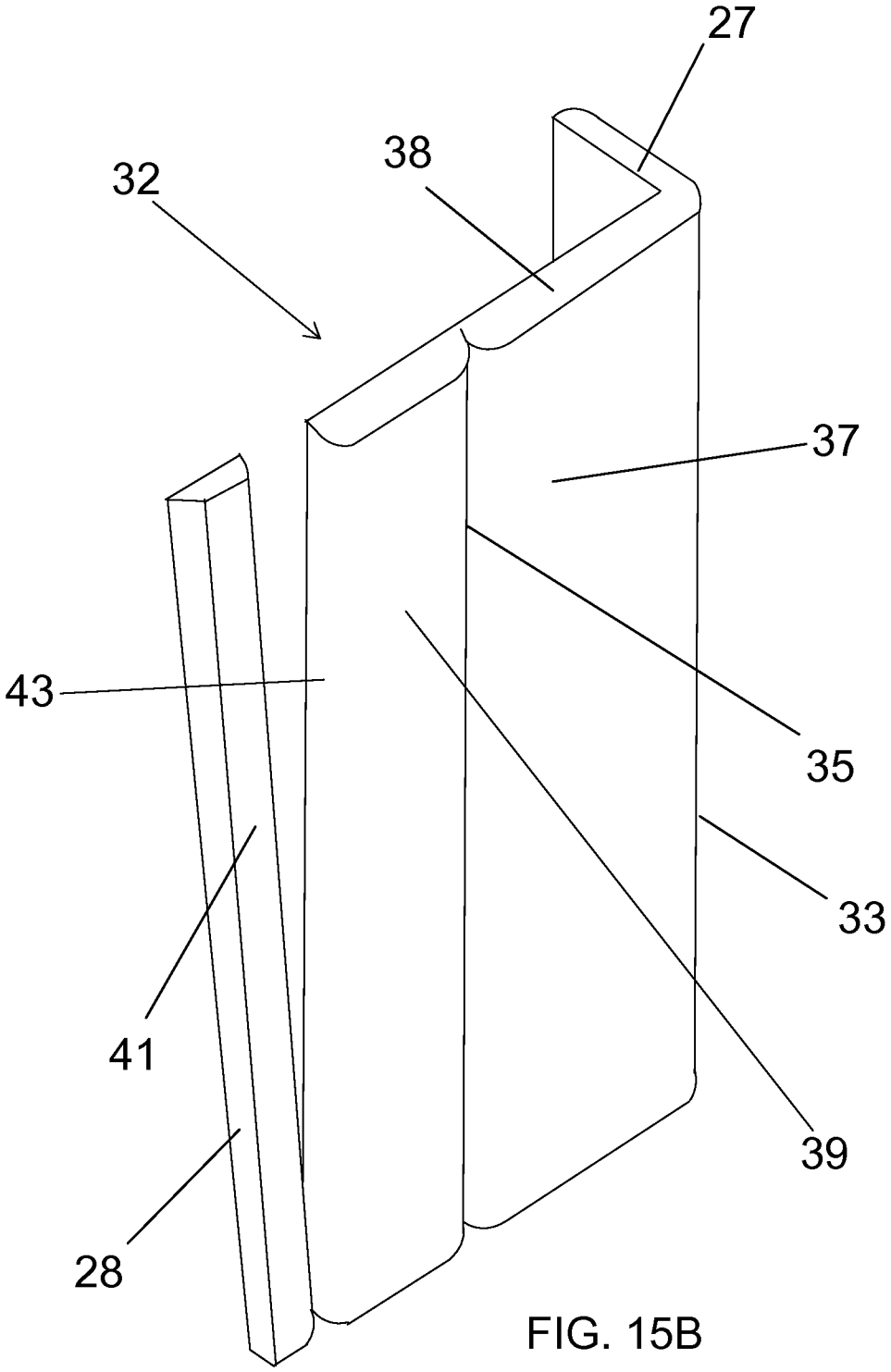
FIG. 15B is a perspective view of another embodiment of the protective restoration covers referred to herein as the jamb shield guards that cover only a portion of a door jamb with a groove cut at a pre-dimensioned width.

In a further embodiment as shown in FIG. 15A, the jamb shield guards 30 and 32 may have grooves 35 to properly size the shields for door jambs 4 of smaller dimensions as described above. As described, the grooves 35 are formed along standard dimensions for door jamb widths, and the shield guards 30 and 32 are resized by cutting along the appropriate groove 35 using a utility knife. The excess material 41 is then snapped off of the shield guards 30 and 32 to produce a clean uniform edge 43, as shown in FIG. 15B.

Figure 16:
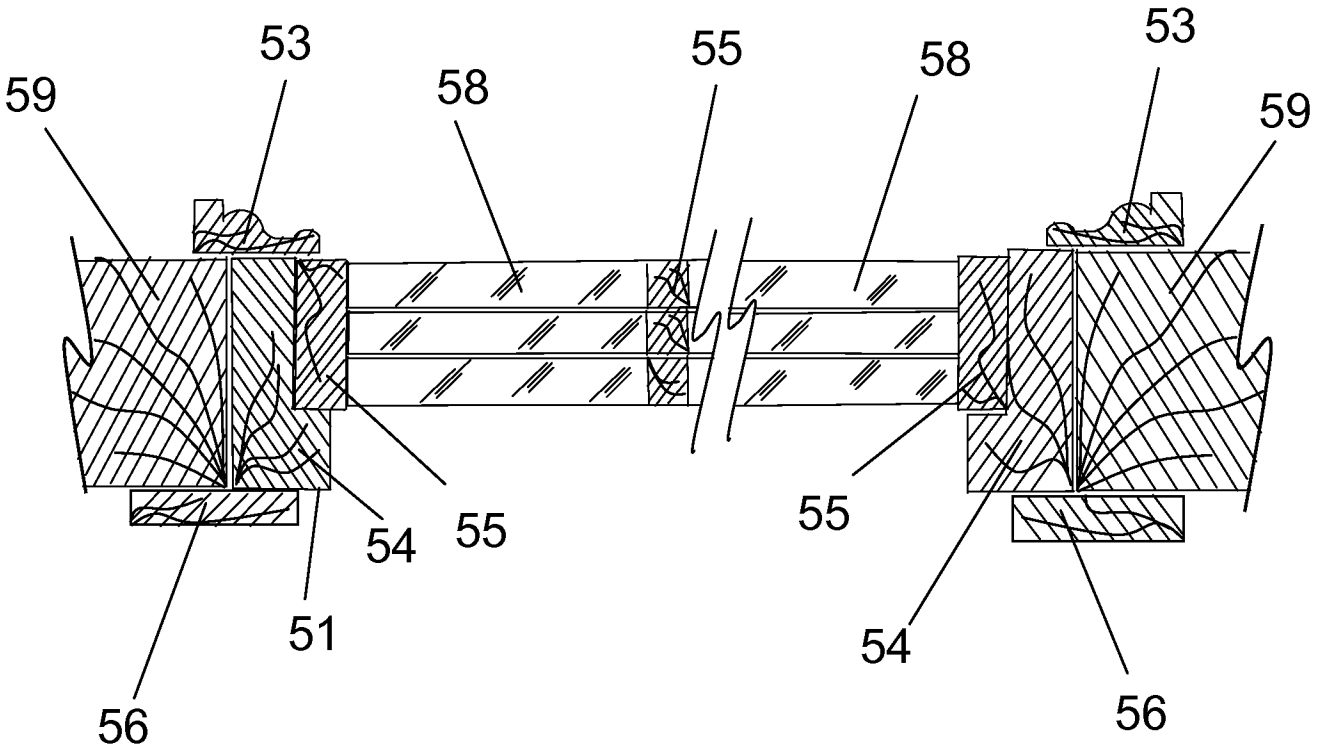
FIG. 16 is a cross-sectional view of a window, window jamb, exterior trim and wall of a building.
Figure 17:
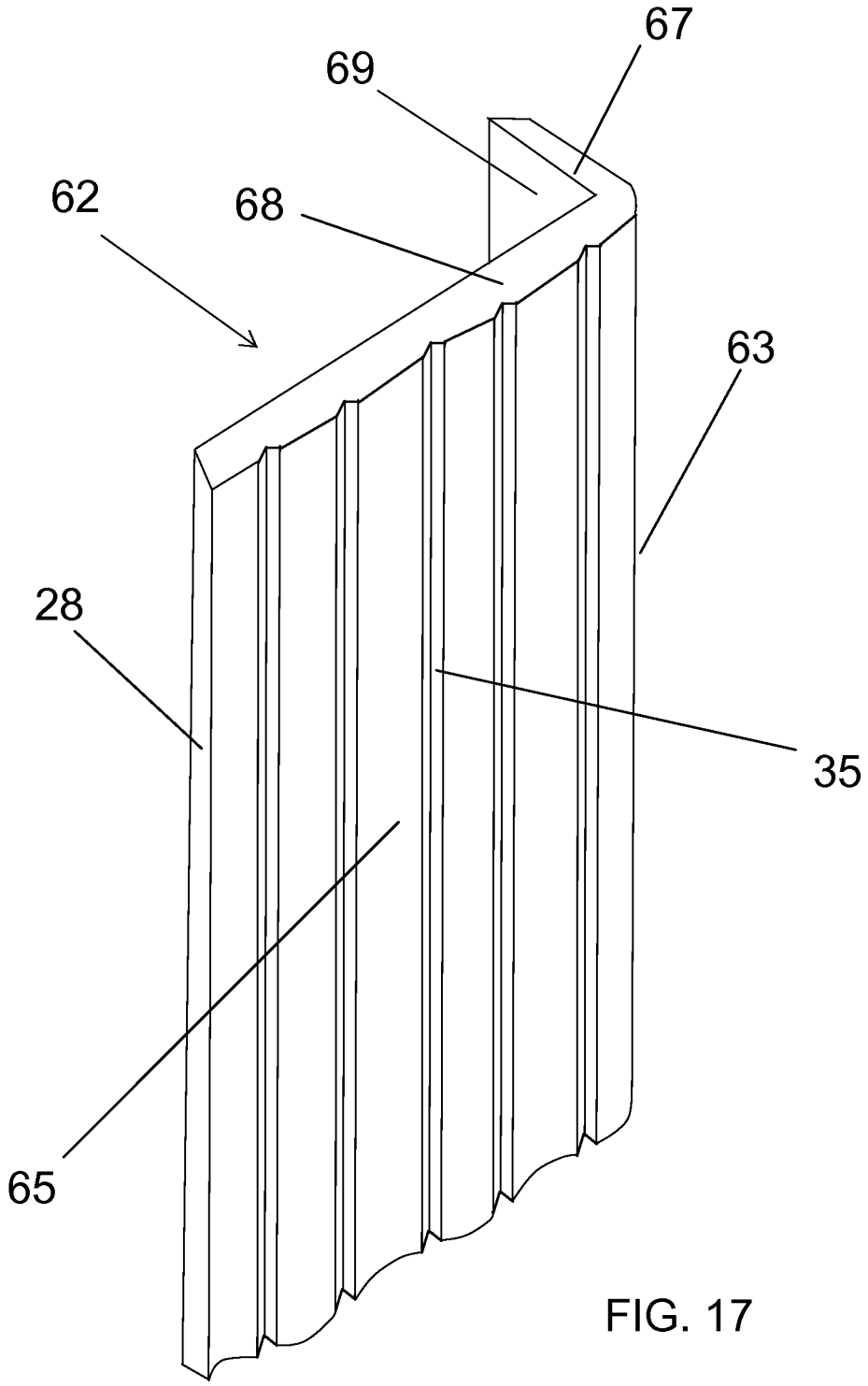
FIG. 17 is a perspective view of a portion of a still further embodiment of the protective restoration cover of the present invention having a number of grooves.

The present invention further provides for protective covers to be used to cover window jambs, frames, and exterior trim. As shown in FIG. 16, a window jamb 54 similarly surrounds a window frame 55 and mounts the window to the wall of a building. Exterior casing 56 aligns along the window jamb 54 and exterior surface of the wall 59 and interior trim 53 is installed along the window jamb 54 and interior surface of the wall 59. The window frame 55 holds the glass window panes 58. However, unlike the width of door jambs 4, window jambs 54 and frames 55 as well as exterior trim 56 are of varying widths with very few standard sizes. For windows, the protective covers are cut, extruded or molded to standard window sizes in length and in width. A number of partially cut grooves 35 are aligned along the length of the protective cover, as shown in FIG. 17, and/or the width of the cover to provide for excess material at the nearest appropriate dimension to be removed to properly size the protective cover in length and width to an adequate dimension for a particular window jamb 54 or frame to cover and seal the jamb or frame from the environment. The top 68 of the protective cover 62 may be formed at a 45° angle as described previously to mate with the 45° angled ends of a horizontal cover installed along the top of the window jamb 54. The cover 62 is formed with a 90° right angle extension 67 along the length of the cover 62 to provide a perpendicular interior surface 69 that abuts and seals along the face 51 of the window jamb 54 to provide support for the cover 62 to be easily aligned and secured in place using the adhesive 17 or other fastener. The edge 63 along the extension 67 is rounded and smooth to prevent sharp edges that may catch or be damaged.

Figure 18A:
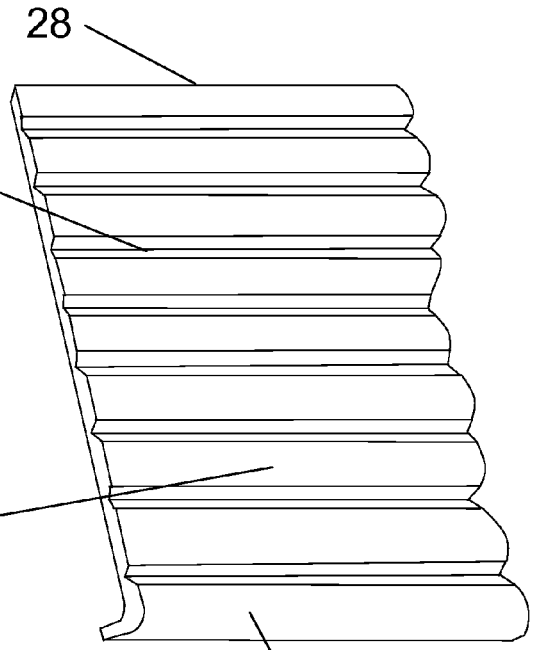
FIG. 18A is a perspective view of a portion of the still further embodiment of a pre-dimensioned protective restoration cover having one or more grooves for various window jamb widths, window frames, and exterior trim.
Figure 18B:
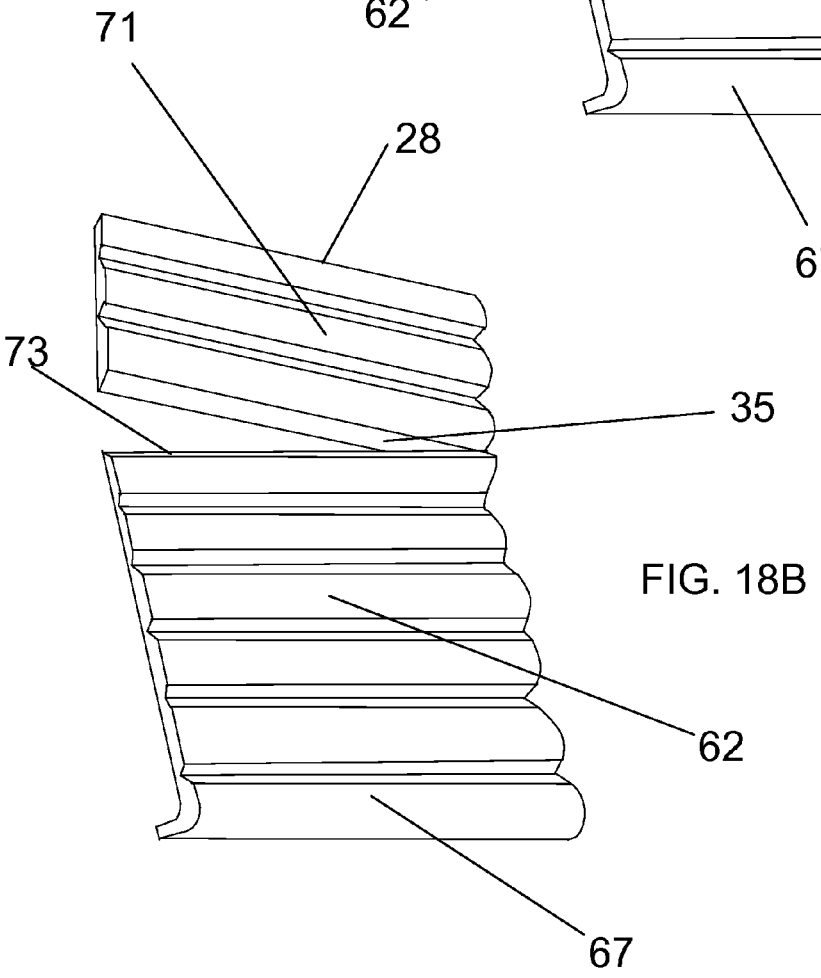
FIG. 18B is a perspective view of a portion of a still further embodiment of a pre-dimensioned protective restoration cover of FIG. 18A cut at one of the pre-dimensioned grooves for various window jamb widths, window frames, and exterior trim.
Figure 19A:
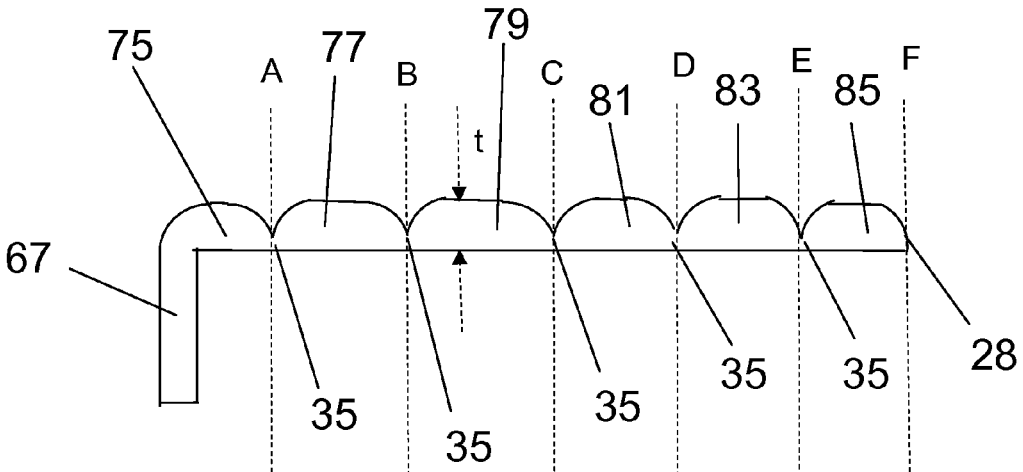
FIG. 19A is an end view of the still further embodiment of the protective restoration cover of the present invention.
Figure 19B:
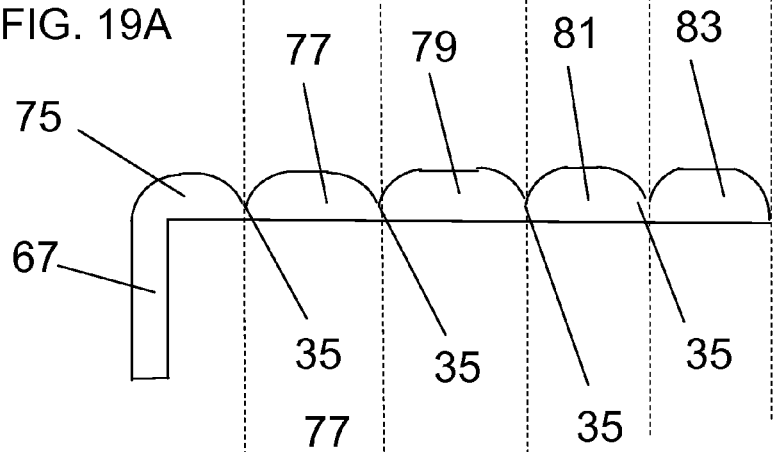
FIG. 19B is an end view of the still further embodiment of the protective restoration cover of the present invention cut to a shorter width than shown in FIG. 19A.
Figure 19C:
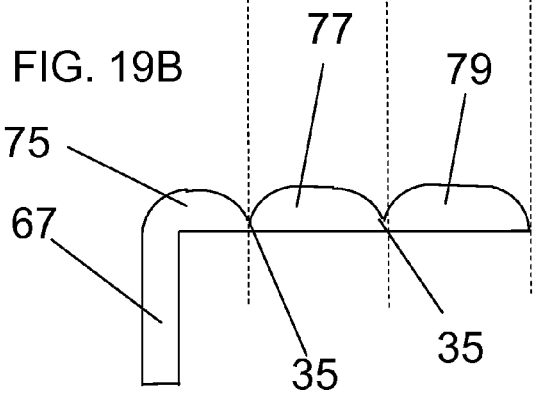
FIG. 19C is an end view of the still further embodiment of the protective restoration cover of the present invention cut to a shorter width than shown in FIG. 19B.
Figure 20:
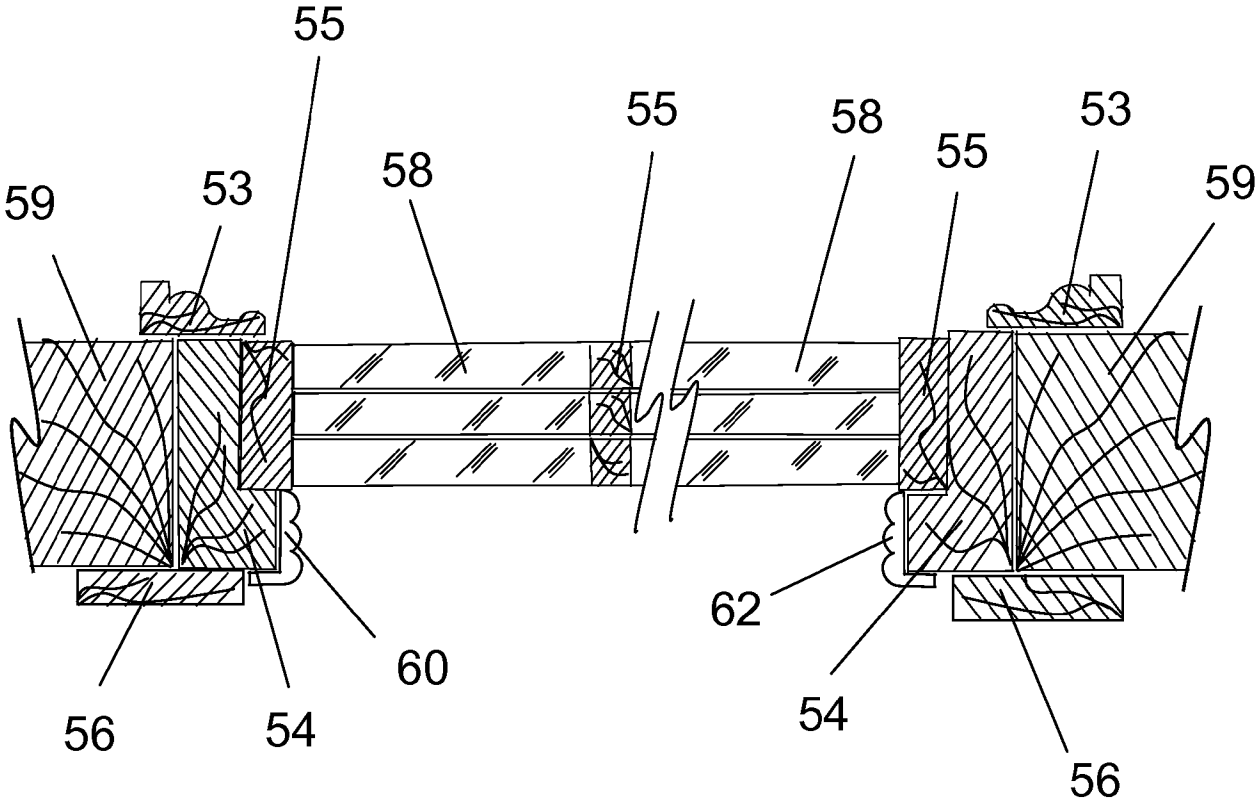
FIG. 20 is a cross-sectional view of a window, window jamb, exterior trim and wall of a building with the still further embodiment of the restoration covers of the present invention installed.

As shown in FIG. 18A, any number of grooves 35 may be provided along the exterior surface 65 of the cover 62 with any remaining grooves 35 providing a decorative element to the window cover. When the appropriate dimension is chosen, a utility knife is run along the groove 35 and because the depth of the groove extends almost through the thickness of the pre-dimensioned cover 62, the excess piece 71 is easily snapped off, as shown in FIG. 18B, and removed from the cover 62 exactly along the groove leaving a smooth uniform edge 73. As shown in FIG. 19A, the restoration cover 62 is dimensioned at a largest standard size F and the grooves 35 are aligned at smaller non-standard sizes A through E with the non-standard size A being the smallest size and non-standard size E being the second to largest size. Any pre-dimensioned size may be selected and with small distances of 1/8 inch to 1/2 inch between the grooves 35 provides for many options available to accommodate many sizes of window jambs 54, frames or exterior trim. As shown in FIG. 19B, any groove may be selected such as along the non-standard size E that with the small distances between the grooves will provide sufficient sealing of the jamb 54. The remaining grooves 35 provide an unobtrusive element along the length of the jamb 62 adding a pleasing design element. For smaller window jambs 54, the non-standard size C may be selected as an example. In this manner, the grooves 35 provide for a single cover to be used to seal door jambs of many different standard sizes. The protective covers 60 and 62 are installed to the window jamb 54 as shown in FIG. 20.

The door restoration covers may be made from a free foam cellular polyvinyl chloride (PVC) trim board or other simulated wood or composite that is of a water and environmentally resistant material that is free of voids, holes, cracks, foreign inclusions and other defects. The restoration covers may be cut and routed from the PVC trim board that is cut to a standard length for a door or window jamb. The PVC trim board may be of a thickness from 1/4 inch to 1 inch of a width from 4 to 6 inches or of any dimension that is larger than standard door or window jamb sizes. The corners of the PVC trim board are square, and the top and bottom surfaces are flat with no convex or concave deviation. In manufacturing the restoration cover, the PVC trim board width is cut or ripped down to the largest of a standard door or window jamb size.

The edges of the trim board are rounded and the grooves are routed along one surface of the cover. Alternatively, the protective covers may be manufactured through a molding process to form the covers with the grooves and rounded edges, or through an extrusion process to form the grooves and cut the covers to the proper length and width.

The protective restoration covers may further be included in a kit that includes an adhesive 17 and provides for a homeowner to easily size the covers to the appropriate dimension using a utility knife and perform the repair. The present invention, however is not recommended for use where due to age and neglect a door jamb 4 or window jamb 54 is rotted underneath and extensive structural damage has occurred to the house or building. The present invention should only be used before any severe wood rot issues have affected the structural integrity. The restoration covers of the present invention will seal wood trim from any further degradation; however the installation over rotted frames and trim may cause serious damage to the house or structure behind the trim that may worsen overtime. A careful check for rot such as by taking a screwdriver and pushing on the wood is required prior to installation of the protective restoration covers. If the screwdriver goes through the wood, that is an indication that the wood is rotted and replacement of the structural components of the building and frame must be completed with and/or in place of installing the protective restoration covers of the present invention.

In installing the protective restoration covers of the present invention, it is advisable that any surface debris such as dirt and paint chips remaining on the jamb, frame or trim be removed and cleaned. Any gaps in the wood should be caulked to prevent further degradation before installation of the restoration covers. The weather stripping 11 traditionally used between the jamb 4 and the door 5 or window 58, may be replaced prior to installation of the restoration covers or shield guards to assist with sealing the outdoor elements out and keeping heating or cooling within the building or structure. The protective restoration cover is then sized and positioned to be properly fitted over each section of the jamb, frame or trim. The pre-fit pieces of the protective restoration covers are sized to fit most standard door or window jambs and for doors most are sized in one of the three standard dimensions. For larger standard door jambs, the cover pieces should fit without any modification to the pre-cut dimensions. For smaller or non-standard jambs, frames or trim, the restoration cover may be sized by cutting along the preformed grooves with a utility knife and breaking off the excess material. In this manner, a single cover may be used to seal and protect jambs, frames and trims of various sizes. Once installed, final caulking along the seams and corners of the cover seals and protects the jamb, frame or trim underneath. The protective covers may then be painted or stained to match the exterior trim of the building.

The invention has been described in detail with particular reference to certain preferred embodiments thereof, but it will be understood that variations and modifications can be effected within the spirit and scope of the invention.

What is claimed is:

1. A method of repairing a degraded jamb of a door or window comprising the steps of:

cleaning a degraded jamb;

sizing a protective cover having a base to a proper width by cutting along a preformed groove that provides a decorative element to the protective cover;

cutting a lower edge of the base at a 6 degree angle to provide for the lower edge of the base to be fitted to a door threshold, snapping off excess material of the cover along the groove;

applying adhesive to the jamb;

applying adhesive to the lower edge of the base to seal the lower edge of the base to a door threshold to prevent precipitation from seeping behind the protective cover; and permanently installing the protective cover over the degraded jamb.

2. The method of repairing a degraded jamb of a door or a window of claim 1 further comprising the steps of forming a rear edge, a flat surface extending from the rear edge and a right angle extension extending from a rounded edge of the flat surface;

dimensioning the protective cover to a length of a standard jamb and to a width of a standard jamb as measured from the right angle extension to the rear edge; and aligning the right angle extension over a face of the degraded jamb.

3. The method of repairing a degraded jamb of a door or a window of claim 2 further comprising the steps of forming a left vertical protective cover by extending a right angle extension left from the flat surface;

forming a right vertical protective cover by extending a right angle extension right from the flat surface.

4. The method of repairing a degraded jamb of a door or a window of claim 3 further comprising the step of forming an upper edge of each of the left and right vertical protective covers at a 45 degree angle.

5. The method of repairing a degraded jamb of a door or a window of claim 4 further comprising the step of forming 45 degree angle at each end of the protective cover to form a horizontal protective cover; and mating the 45 degree angle of the left and right vertical protective covers to each end having a 45 degree angle of the horizontal protective cover.

* * * * *